US010488800B2

(12) United States Patent
Shirasaka

(10) Patent No.: US 10,488,800 B2
(45) Date of Patent: Nov. 26, 2019

(54) IMAGE FORMING SYSTEM, METHOD FOR CONTROLLING IMAGE FORMING SYSTEM, AND PAPER CONVEYANCE PROCESSING APPARATUS

(71) Applicant: Konica Minolta, Inc., Tokyo (JP)

(72) Inventor: Satoru Shirasaka, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 29 days.

(21) Appl. No.: 15/645,500

(22) Filed: Jul. 10, 2017

(65) Prior Publication Data

US 2018/0024484 A1 Jan. 25, 2018

(30) Foreign Application Priority Data

Jul. 20, 2016 (JP) ..... 2016-142696

(51) Int. Cl.
*G03G 15/00* (2006.01)
*G03G 15/01* (2006.01)

(52) U.S. Cl.
CPC ..... *G03G 15/5029* (2013.01); *G03G 15/0142* (2013.01); *G03G 15/6517* (2013.01); *G03G 15/6529* (2013.01)

(58) Field of Classification Search
CPC ..... G03G 15/5029
USPC ..... 399/18
See application file for complete search history.

(56) References Cited

U.S. PATENT DOCUMENTS 7,590,362 B2 * 9/2009 Yamauchi ..... G03G 15/5004 399/18
8,355,642 B2 * 1/2013 Shoji ..... G03G 15/6529 399/20
9,857,752 B2 * 1/2018 Nishi ..... G03G 15/55
2007/0057445 A1 3/2007 Miyake et al.
(Continued)

FOREIGN PATENT DOCUMENTS

JP 2007210775 A 8/2007
JP 2016105143 A 6/2016

OTHER PUBLICATIONS

Official 1st Examination Opinion Notice dated Nov. 30, 2018 from corresponding Chinese Patent Application No. 201710590475.4 and English translation.

(Continued)

*Primary Examiner* — Anthony H Nguyen
(74) *Attorney, Agent, or Firm* — Lucas & Mercanti, LLP

(57) ABSTRACT

Provided is an image forming system which optimizes subsequent processes for crossing paper when a causing apparatus has stopped in the state in which paper is spanning the causing apparatus and a downstream apparatus. The image forming system conveys the paper from a first apparatus (the causing apparatus) to a second apparatus (the downstream apparatus) connected to the first apparatus. The image forming system 1 includes a conveying unit and a hardware processor. The conveying unit conveys the paper. The hardware processor determines, in a case where the paper is normally conveyed by the conveying unit across the first apparatus and the second apparatus, whether processes of the first apparatus has been completed for crossing paper which is the paper spanning the first apparatus and the second apparatus, when the first apparatus stops due to an abnormality.

28 Claims, 12 Drawing Sheets

(56) References Cited

U.S. PATENT DOCUMENTS

| | | | | |
|---|---|---|---|---|
| 2007/0059057 | A1* | 3/2007 | Kinoshita | G03G 15/2064 399/322 |
| 2008/0175607 | A1* | 7/2008 | Willis | G03G 15/55 399/20 |
| 2009/0226193 | A1* | 9/2009 | Muratani | G03G 15/6573 399/21 |
| 2010/0119244 | A1* | 5/2010 | Kitagawa | G03G 15/2064 399/21 |
| 2011/0133386 | A1 | 6/2011 | Miyake et al. | |
| 2014/0294406 | A1* | 10/2014 | Eguchi | G03G 15/706 399/22 |
| 2014/0334834 | A1* | 11/2014 | Katsuyama | G03G 15/70 399/21 |

OTHER PUBLICATIONS

Office Action from corresponding Chinese Patent Application No. 201710590475.4 dated Jun. 10, 2019 with English translation (20 pages).

* cited by examiner

IMAGE FORMING SYSTEM, METHOD FOR CONTROLLING IMAGE FORMING SYSTEM, AND PAPER CONVEYANCE PROCESSING APPARATUS

CROSS-REFERENCE TO RELATED APPLICATION

Japanese Patent Application No. 2016-142696 filed on Jul. 20, 2016, including description, claims, drawings, and abstract the entire disclosure is incorporated herein by reference in its entirety.

BACKGROUND

1. Technological Field

The present invention relates to an image forming system, a method for controlling an image forming system, and a paper conveyance processing apparatus.

2. Description of the Related Art

There has been generally known an image forming system in which an image forming apparatus and one or more post-processing apparatuses are connected to each other. In such a system, during conveyance of paper, an abnormality may occur in any apparatus. An apparatus in which an abnormality has been detected (hereinafter, referred to as a "causing apparatus") stops operating.

In this case, apparatuses, other than the causing apparatus in the image forming system, are respectively controlled such that waste of paper and processes does not occur. See Japanese Patent Publication No. 2007-210775. In this technique, an apparatus positioned on an upstream side of the causing apparatus on the paper conveyance (hereinafter, referred to as an "upstream apparatus") is notified of an abnormality from the causing apparatus and stops the conveyance of paper to the causing apparatus.

On the other hand, an apparatus positioned on a downstream side of the causing apparatus on the paper conveyance (hereinafter, referred to as a "downstream apparatus") may continue performing operation, such as paper conveyance, in order to prevent paper being processed from being wasted. For example, in a case where paper is conveyed across the causing apparatus and the downstream apparatus, when the causing apparatus stops, the paper spanning the causing apparatus and the downstream apparatus (hereinafter, referred to as a "crossing paper") may be drawn out to the downstream apparatus, which continues the conveyance, from the causing apparatus having stopped the conveyance.

However, a part of the crossing paper is positioned inside the causing apparatus. Therefore, the crossing paper may be not paper subjected to all processes of the causing apparatus (hereinafter, referred to as an "effective paper"), and may be paper not subjected to some processes (hereinafter, referred to as an "ineffective paper").

Since the downstream apparatus is not able to know whether the crossing paper is the effective paper or the ineffective paper, the downstream apparatus performs the same process for all of the effective paper and the ineffective paper. Therefore, since the downstream apparatus performs a normal process for the ineffective paper to be discarded later, there is a problem that wasteful processing occurs.

Furthermore, the effective paper and the ineffective paper continuously conveyed are discharged to the same paper discharge tray. Consequently, a user is required to confirm whether there is the ineffective paper among output objects. Moreover, when the user is not able to easily determine the presence or absence of the ineffective paper, there is also a problem that waste of paper occurs, since it is necessary to perform printing again.

SUMMARY

The present invention is achieved in view of the problems described above. Therefore, an object of the present invention is to provide an image forming system in which, in a case where the paper is normally conveyed across a causing apparatus and a downstream apparatus, when the causing apparatus stops due to an abnormality, subsequent processing for crossing paper is optimized, and a method for controlling the image forming system, and a paper conveyance processing apparatus.

To achieve at least one of the abovementioned objects, according to an aspect of the present invention, an image forming system which conveys paper from a first apparatus to a second apparatus connected to the first apparatus, reflecting one aspect of the present invention, comprises a conveying unit which conveys the paper; and a hardware processor which determines, in a case where the paper is normally conveyed by the conveying unit across the first apparatus and the second apparatus, whether processes of the first apparatus has been completed for crossing paper which is the paper spanning the first apparatus and the second apparatus when the first apparatus stops due to an abnormality.

To achieve at least one of the abovementioned objects, according to an aspect of the present invention, a method for controlling an image forming system comprising a conveying unit for conveying paper from a first apparatus to a second apparatus connected to the first apparatus, reflecting one aspect of the present invention, comprises (a) determining presence or absence of crossing paper, which is the paper spanning the first apparatus and the second apparatus when the first apparatus stops due to an abnormality; and (b) determining whether processes of the first apparatus has been completed for the crossing paper when it is determined that the crossing paper exists in the step (a).

To achieve at least one of the abovementioned objects, according to an aspect of the present invention, a paper conveyance processing apparatus which performs predetermined processes for paper to be conveyed and is connectable to another paper conveyance processing apparatus, reflecting one aspect of the present invention, comprises a first conveying unit which conveys the paper; a processing unit which performs the predetermined processes for the paper; and a hardware processor that determines, in a case where the paper is normally conveyed by the conveying unit across the paper conveyance processing apparatus and the other paper conveyance processing apparatus, whether the predetermined processes has been completed for crossing paper which is conveyed across the paper conveyance processing apparatus and the other paper conveyance processing apparatus, when the paper conveyance processing apparatus stops due to an abnormality.

The objects, features, and characteristics of this invention other than those set forth above will become apparent from the description given herein below with reference to preferred embodiments illustrated in the accompanying drawings.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
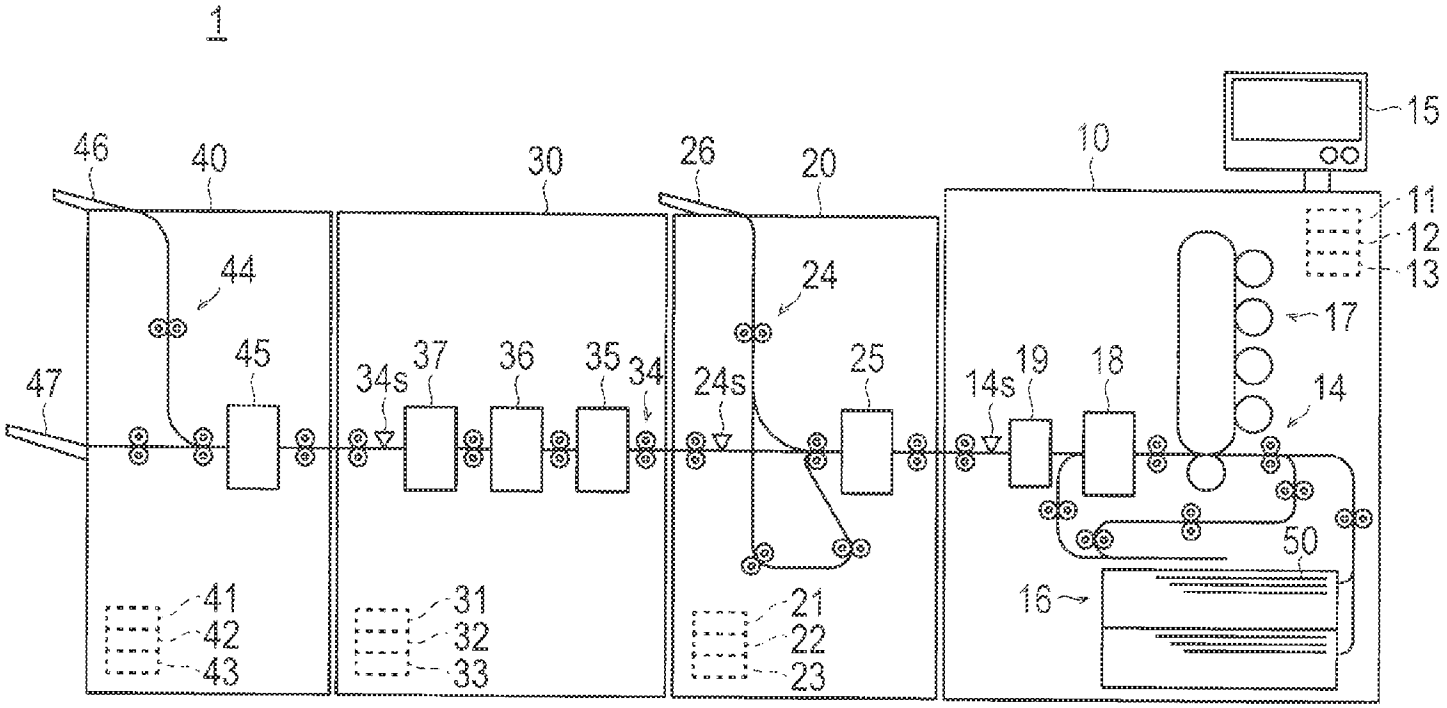
FIG. 1 is a diagram illustrating a schematic configuration of an image forming system according to an embodiment of the present invention.

Hereinafter, one or more embodiments of the present invention will be described with reference to the drawings. However, the scope of the invention is not limited to the disclosed embodiments.

In the description of the drawings, the same elements are denoted by the same reference numerals, and redundant description is omitted. In addition, in some cases, dimensional ratios in the drawings are exaggerated and different from actual ratios for convenience of the description.

Firstly, schematic configurations of an image forming system and each apparatus will be described.

Figure 2:
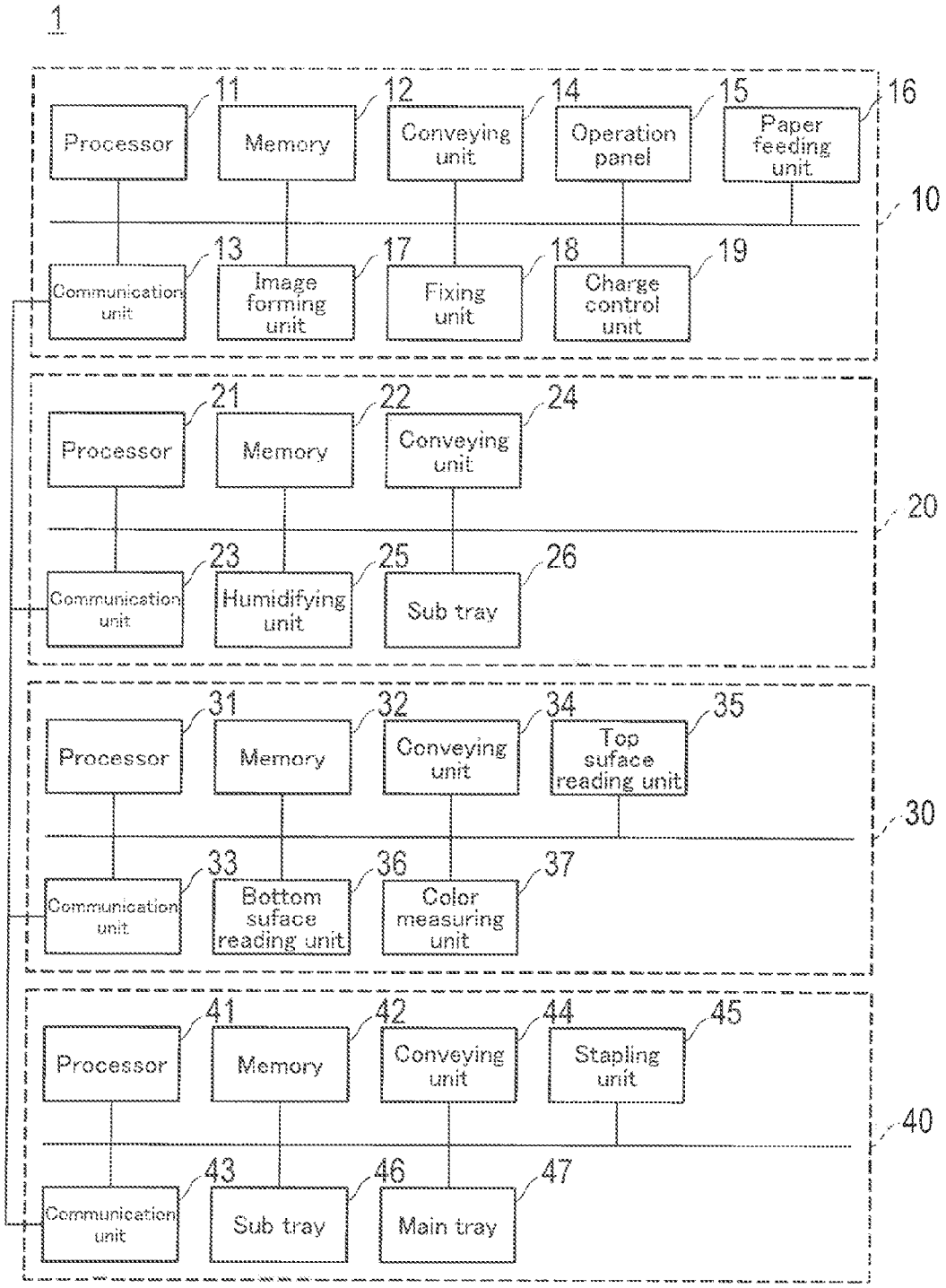
FIG. 2 is a block diagram illustrating schematic configurations of an image forming apparatus, a humidifying apparatus, a reading apparatus, and a stapling apparatus.

FIG. 1 is a diagram illustrating a schematic configuration of an image forming system according to an embodiment of the present invention. FIG. 2 is a block diagram illustrating schematic configurations of an image forming apparatus, a humidifying apparatus, a reading apparatus, and a stapling apparatus.

As illustrated in FIG. 1 and FIG. 2, an image forming system 1 comprises an image forming apparatus 10, a humidifying apparatus 20, a reading apparatus 30, and a stapling apparatus 40. The image forming apparatus 10, the humidifying apparatus 20, the reading apparatus 30, and the stapling apparatus 40 are connected in an order from an upstream side to a downstream side of paper conveyance. In the present embodiment, as an example of post-processing apparatuses, the humidifying apparatus 20, the reading apparatus 30, and the stapling apparatus 40 are illustrated; however, the type and number of the post-processing apparatuses are not limited thereto.

The image forming apparatus 10 comprises a processor (hardware processor) 11, a memory 12, a communication unit 13, a conveying unit 14, an operation panel 15, a paper feeding unit 16, an image forming unit 17, a fixing unit 18, and a charge control unit 19. These are connected to one another via a bus for exchanging signals. The image forming apparatus 10 forms an image on paper 50, which is a recording material, by using an electrophotographic process on the basis of image data.

The processor 11 is a CPU (Central Processing Unit) and performs control of the aforementioned respective units and various arithmetic processes according to programs. The functional configuration of the processor 11 will be described later.

The memory 12 includes ROM (Read Only Memory) for storing various programs and various kinds of data in advance, RAM (Random Access Memory) for temporarily storing programs and data as a work area, a hard disk for storing various programs and various kinds of data, and the like.

The communication unit 13 is an interface for communicating with other devices, and transmits/receives various kinds of data, various signals and the like to/from the humidifying apparatus 20, the reading apparatus 30, and the stapling apparatus 40. The communication unit 13 can also transmit/receive various kinds of data and the like to/from a PC (Personal Computer), a mobile terminal and the like of a user via a network.

The conveying unit 14 comprises a plurality of conveying roller pairs and a driving motor (not illustrated), and conveys paper, which has been fed from the paper feeding unit 16 to be described later, to each unit. The conveying unit 14 comprises a paper discharge sensor 14*s* in the vicinity of a conveying roller pair positioned at the most downstream of paper conveyance. The paper discharge sensor 14*s* is configured to transmit, to the processor 11, a notification indicating the passage of that paper 50 (hereinafter, referred to as a "paper passage notification") during the detection of the paper 50 being conveyed.

The operation panel 15 comprises a touch panel, a numeric keypad, a start button, a stop button, and the like, and is used for displaying various kinds of information and inputting various instructions.

The paper feeding unit 16 stores the paper 50 and feeds the paper 50 one by one. The paper feeding unit 16 may comprise a plurality of paper feeding trays as illustrated in FIG. 1.

The image forming unit 17 transfers an image to the paper 50 by using a well-known imaging process such as an electrophotographic process including each process of charging, exposure, development, transfer, and fixing.

The fixing unit 18 comprises a pressure roller and a heating roller (not illustrated), and presses and heats the paper 50 with the image transferred by the image forming unit 17, thereby thermally fixing the image on the paper 50.

The charge control unit 19 comprises a pair of charging rollers (not illustrated), and charges the paper 50 with the image fixed by the fixing unit 18, thereby preventing adhesion of sheets of the paper 50.

The humidifying apparatus 20 comprises a processor (hardware processor) 21, a memory 22, a communication unit 23, a conveying unit 24 (including a paper discharge sensor 24*s*), a humidifying unit 25, and a sub-tray 26. These are connected to one another via a bus for exchanging signals. Since the processor 21, the memory 22, the communication unit 23, and the conveying unit 24 have functions similar to those of the processor 11, the memory 12, the communication unit 13, and the conveying unit 14 of the image forming apparatus 10, a description thereof will be omitted.

The humidifying unit 25 comprises a pair of humidifying rollers (not illustrated), humidifies the paper 50 conveyed from the image forming apparatus 10, and reduces bending, waving, waviness and the like of the paper 50.

The sub-tray 26 is used as a tray for discharging the paper 50 to an exterior of the humidifying apparatus 20. The sub-tray 26 can also be used as a purge tray for discharging the paper 50 with a problem during conveyance.

The reading apparatus 30 comprises a processor (hardware processor) 31, a memory 32, a communication unit 33, a conveying unit 34 (including a paper discharge sensor 34*s*), a top surface reading unit 35, a bottom surface reading unit 36, and a color measuring unit 37. These are connected to one another via a bus for exchanging signals. Since the processor 31, the memory 32, the communication unit 33, and the conveying unit 34 have functions similar to those of the processor 11, the memory 12, the communication unit 13, and the conveying unit 14 of the image forming apparatus 10, a description thereof will be omitted.

The top surface reading unit 35 comprises a CCD (Charge Coupled Device) line sensor or a CIS (Contact Image Sensor), and reads an image formed on the top surface of the paper 50 conveyed from the humidifying apparatus 20. The top surface reading unit 35 reads an image of an entire area in the width direction of the paper 50.

The bottom surface reading unit 36 comprises a CCD line sensor or a CIS, and reads an image formed on the bottom surface of the paper 50. The bottom surface reading unit 36 reads an image of the entire area in the width direction of the paper 50.

The color measuring unit 37 comprises, for example, a spectral colorimeter and measures a color of the image formed on the top surface of the paper 50. The color measuring unit 37 reads a color of a predetermined area in the width direction of the paper 50.

In the reading apparatus 30, color information acquired by reading an image by the top surface reading unit 35 and the bottom surface reading unit 36 can be corrected to elaborate color information acquired by measuring a color of the image by the color measuring unit 37. In this way, the reading apparatus 30 is configured to improve the accuracy of color information which is fed back to the image forming apparatus 10.

The stapling apparatus 40 comprises a processor (hardware processor) 41, a memory 42, a communication unit 43, a conveying unit 44, a stapling unit 45, a sub-tray 46, and a main tray 47. These are connected to one another via a bus for exchanging signals. Since the processor 41, the memory 42, the communication unit 43, and the conveying unit 44 have functions similar to those of the processor 11, the memory 12, the communication unit 13, and the conveying unit 14 of the image forming apparatus 10, a description thereof will be omitted.

The stapling unit 45 performs a stapling process on the paper 50 conveyed from the reading apparatus 30.

The sub-tray 46 has functions similar to those of the sub-tray 26 and can be used as a purge tray for discharging the paper 50 with a problem during conveyance.

The main tray 47 is used as a normal tray for discharging the paper 50 subjected to the processes of the image forming system 1 to an exterior of the stapling apparatus 40.

The image forming apparatus 10, the humidifying apparatus 20, the reading apparatus 30, and the stapling apparatus 40 may include components other than the aforementioned components, or may not include a part of the aforementioned components. For example, the image forming apparatus 10 may further comprise an image reading unit for reading an image, and the like, and the reading apparatus 30 may further comprise a tray available as a purge tray, and the like. Furthermore, the stapling apparatus 40 may further comprise a punching unit for performing a punching process, a binding unit for performing a binding process, and the like.

Next, a functional configuration of the processor of each apparatus will be described.

Figure 3:
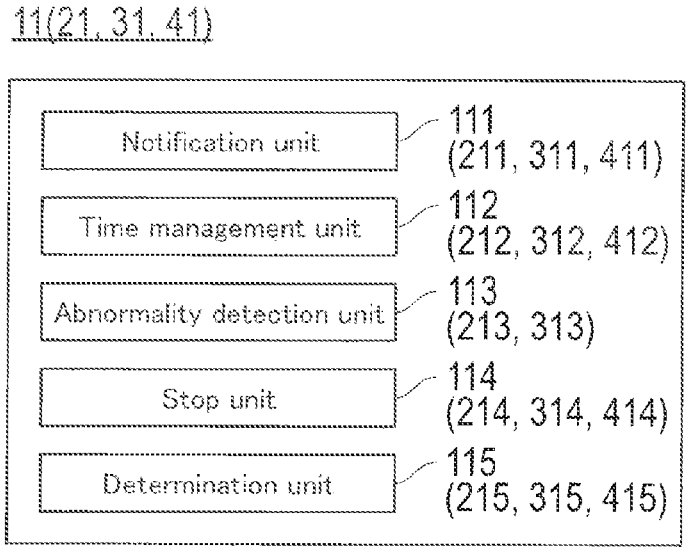
FIG. 3 is a block diagram illustrating a functional configuration of a processor of the image forming apparatus.

FIG. 3 is a block diagram illustrating a functional configuration of the processor of the image forming apparatus.

In the present embodiment, the processor 11 of the image forming apparatus 10 reads a program to perform processes, thereby serving as a notification unit 111, a time management unit 112, an abnormality detection unit 113, a stop unit 114, and a determination unit 115.

The notification unit 111 receives a notification from each unit of the image forming apparatus 10. The notification unit 111 transmits/receives a notification to/from each apparatus of the image forming system 1 via the communication unit 13.

The time management unit 112 records a time as necessary. The time management unit 112 can check an elapsed time between two times.

The abnormality detection unit 113 detects an abnormality which occurs in each unit of the image forming apparatus 10. For example, when a notification indicating opening of a door of the image forming apparatus 10 during its operation is received from a sensor provided to the door, the abnormality detection unit 113 detects it as an abnormality. Even when power is not supplied to the image forming apparatus 10 due to a reason such as unplugging of a power cord, and the like, during the operation of the image forming apparatus 10, the abnormality detection unit 113 also detects it as an abnormality. Even when power is not supplied through the power cord, the processor 11 including the abnormality detection unit 113 can be configured to continue processes if power can be supplied to the image forming apparatus 10 from other apparatuses or if the image forming apparatus 10 has a standby power therein. Consequently, even when power is not supplied through the power cord, the abnormality detection unit 113 can detect an abnormality. The type of abnormality occurring in each unit of the image forming apparatus 10 is not limited thereto. The abnormality detection unit 113, for example, can also detect an abnormality caused by jam of the paper 50, and the like, in each unit in addition to the aforementioned abnormality not caused by the paper 50 being conveyed.

The stop unit 114 stops operations of the whole or a part of the image forming apparatus 10 as necessary. For example, when the abnormality detection unit 113 has detected an abnormality indicating the opening of the door of the image forming apparatus 10 during its operation, the stop unit 114 stops the operations of the image forming apparatus 10. Furthermore, the stop unit 114 can confirm that the operations of the whole or a part of the image forming apparatus 10 have stopped. For example, when the abnormality detection unit 113 has detected an abnormality in which no power is supplied, the stop unit 114 can confirm that the operations of the image forming apparatus 10 have been stopped.

The determination unit 115 performs determination for the paper 50 and the like as necessary. The determination process will be described later.

In the present embodiment, the processor 21 of the humidifying apparatus 20 reads a program to perform processes, thereby serving as a notification unit 211, a time management unit 212, an abnormality detection unit 213, a stop unit 214, and a determination unit 215. Furthermore, the processor 31 of the reading apparatus 30 also reads a program to perform processes, thereby serving as a notification unit 311, a time management unit 312, an abnormality detection unit 313, a stop unit 314, and a determination unit 315. Moreover, the processor 41 of the stapling apparatus 40 also reads a program to perform processes, thereby serving as a notification unit 411, a time management unit 412, a stop unit 414, and a determination unit 415. Since each of these components serves similarly to the notification unit 111, the time management unit 112, the abnormality detection unit 113, the stop unit 114, and the determination unit 115, a description thereof will be omitted. Since the stapling apparatus 40 is positioned at the most downstream of paper conveyance, the processor 41 does not need to serve as an abnormality detection unit.

Next, the determination process performed in the image forming system 1 of the present embodiment will be described.

Figure 4:
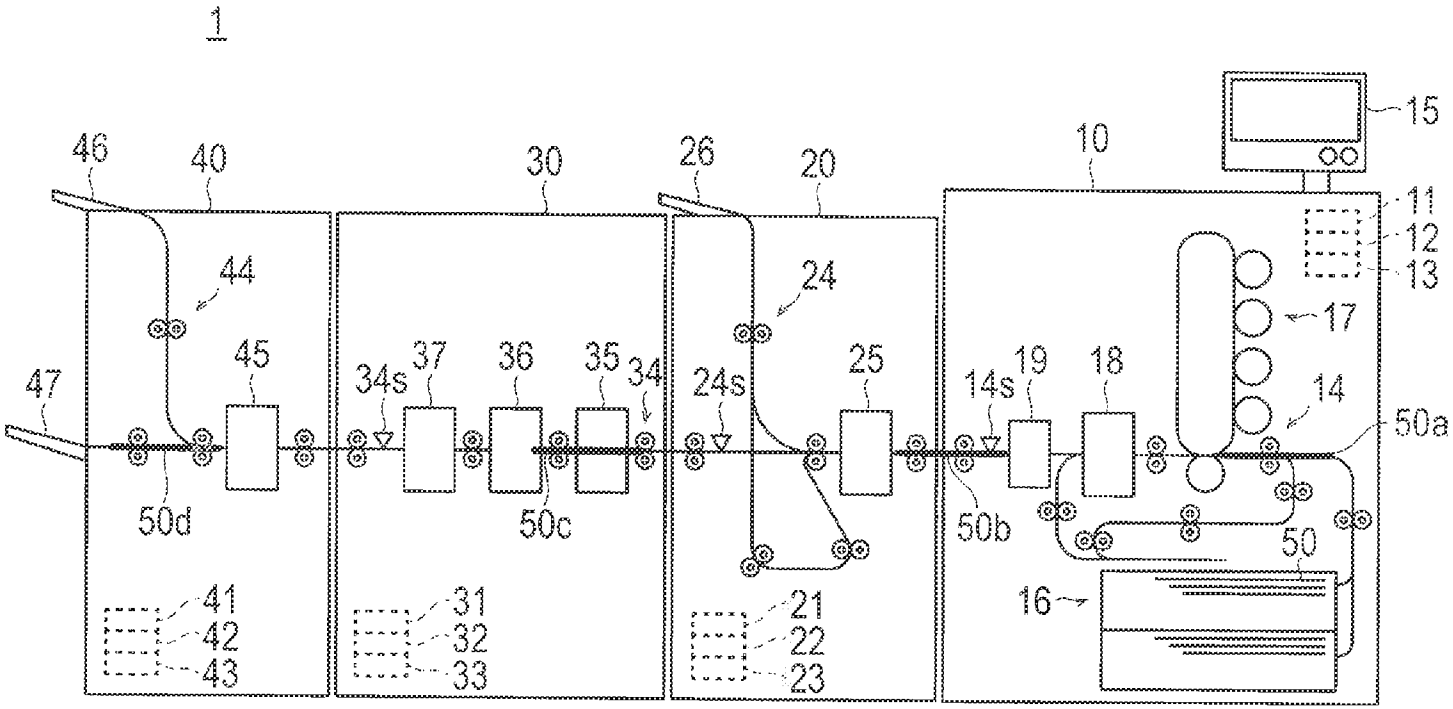
FIG. 4 is a diagram for explaining subsequent processes when the image forming apparatus has stopped.
Figure 5:
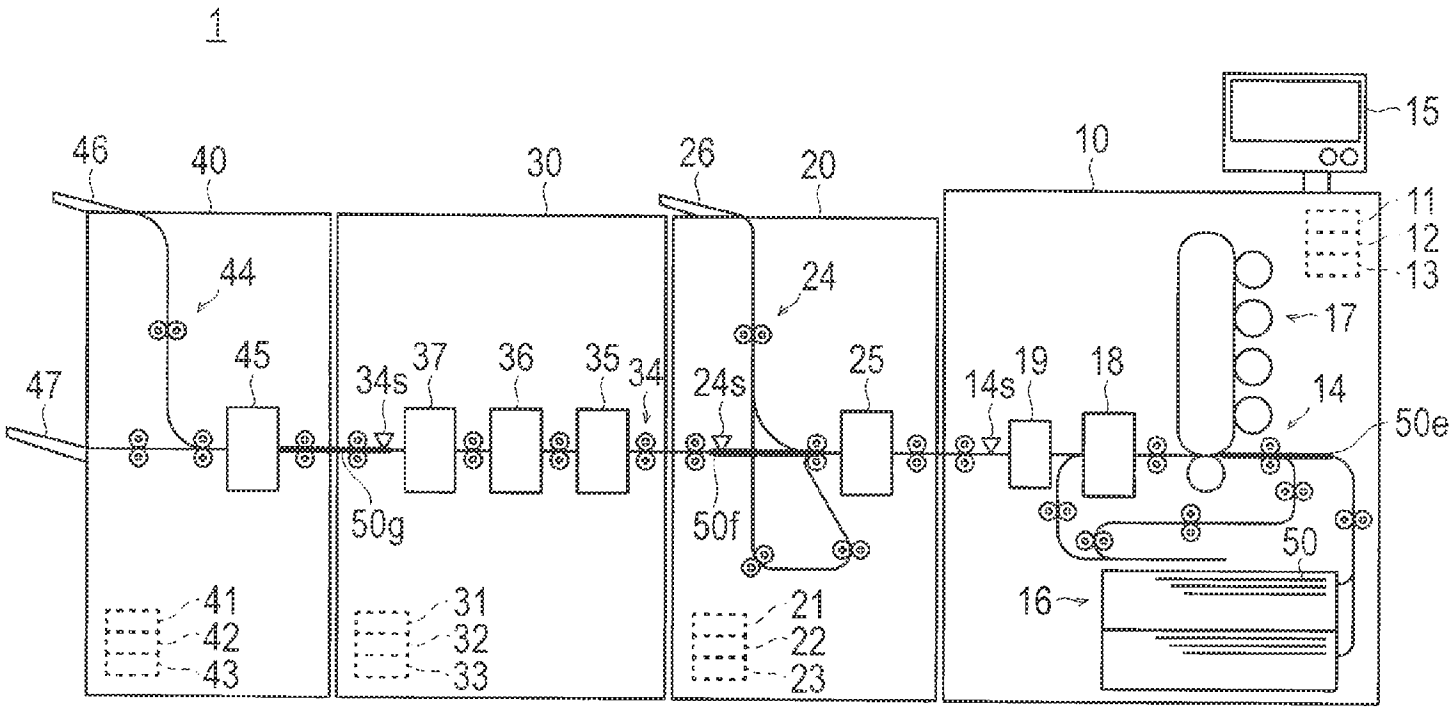
FIG. 5 is a diagram for explaining subsequent processes when the reading apparatus has stopped.

FIG. 4 is a diagram for explaining subsequent processes when the image forming apparatus has stopped. FIG. 5 is a diagram for explaining subsequent processes when the reading apparatus has stopped.

In examples of FIG. 4 and FIG. 5, the image forming system 1 conveys the paper 50 by the conveying units 14, 24, 34, and 44 of the respective apparatuses. Firstly, a description will be provided for subsequent processes when the image forming apparatus 10 has stopped due to an abnormality in the state of paper conveyance of FIG. 4.

Paper 50*a* is positioned in the image forming apparatus 10 which is a causing apparatus (a first apparatus). When the conveying unit 14 of the image forming apparatus 10 stops operating due to the abnormality of the image forming apparatus 10, conveyance of the paper 50*a* is stopped.

Paper 50*c* and paper 50*d* are respectively positioned in the reading apparatus 30 and the stapling apparatus 40 which are downstream apparatuses not connected to the causing apparatus. There is a case where the conveying unit 34 of the reading apparatus 30 and the conveying unit 44 of the stapling apparatus 40 continue operating such that the paper 50*c* and the paper 50*d* are not wasted. In this case, conveyance of the paper 50*c* and the paper 50*d* is continued and subsequent processes are also continued for the paper 50*c* and the paper 50*d*.

On the other hand, paper 50*b* is crossing paper positioned across the image forming apparatus 10, which is the causing apparatus, and the humidifying apparatus 20, which is a downstream apparatus (a second apparatus) connected to the causing apparatus. The crossing paper occurs due to the image forming apparatus 10 stopping due to an abnormality when the paper 50*b* is normally conveyed across the image forming apparatus 10 and the humidifying apparatus 20. Even when the conveying unit 14 of the image forming apparatus 10 stops operating due to the abnormality of the image forming apparatus 10, there is a case where the conveying unit 24 of the humidifying apparatus 20 continues operating. In this case, the conveying unit 24 intends to pull out the paper 50*b* from the stopped conveying unit 14.

However, a part of the paper 50*b* is positioned inside the image forming apparatus 10. Consequently, there is a case where a rear end of the paper 50*b* has not pass through the fixing unit 18 or the charge control unit 19, depending on the size of the paper 50*b* or spanning condition of the paper 50*b*. In this case, the paper 50*b* becomes ineffective paper in which some processes of the image forming apparatus 10 have not been completed. When the paper 50*b* is the ineffective paper, if the conveying unit 24 pulls out the paper 50*b* from the stopped conveying unit 14 and conveys the paper 50*b*, since subsequent normal processes are performed for the paper 50*b*, wasteful processing occurs.

In this regard, in the present embodiment, the processor 11 of the image forming apparatus 10 serves as the determination unit 115 such that wasteful processing does not occur. The determination unit 115 determines the presence or absence of crossing paper, and determines whether the crossing paper is effective paper or ineffective paper when there is the crossing paper. Then, when the determination unit 115 determines that the crossing paper is the ineffective paper, the conveying unit 24 is controlled not to pull out the crossing paper from the conveying unit 14.

Processes of the determination units of the apparatuses, other than the image forming apparatus 10, are similar to the above. A description will be provided, as an example, for subsequent processes when the reading apparatus 30 has stopped due to an abnormality in the state of the paper conveyance of FIG. 5.

Paper 50*e* and paper 50*f* are respectively positioned in the image forming apparatus 10 and the humidifying apparatus 20 which are upstream apparatuses. When the reading apparatus 30 stops operating due to an abnormality of the reading apparatus 30, the conveying unit 14 of the image forming apparatus 10 and the conveying unit 24 of the humidifying apparatus 20 stop operating such that the paper 50 is not conveyed to the stopped reading apparatus 30. Consequently, the conveyance of the paper 50*e* and the paper 50*f* is stopped.

On the other hand, paper 50*g* is crossing paper positioned across the reading apparatus 30, which is a causing apparatus, and the stapling apparatus 40 which is a downstream apparatus connected to the causing apparatus. Even when the conveying unit 34 of the reading apparatus 30 stops operating due to an abnormality of the reading apparatus 30, there is a case where the conveying unit 44 of the stapling apparatus 40 continues operating. In this case, the conveying unit 44 intends to pull out the paper 50*g* from the stopped conveying unit 34. Consequently, when the paper 50*g* is ineffective paper, the processor 31 of the reading apparatus 30 serves as the determination unit 315 such that subsequent normal processes are not performed for the paper 50*g*.

(Processes of Causing Apparatus)

Next, details of the processes of a causing apparatus in the present embodiment will be described.

Figure 6:
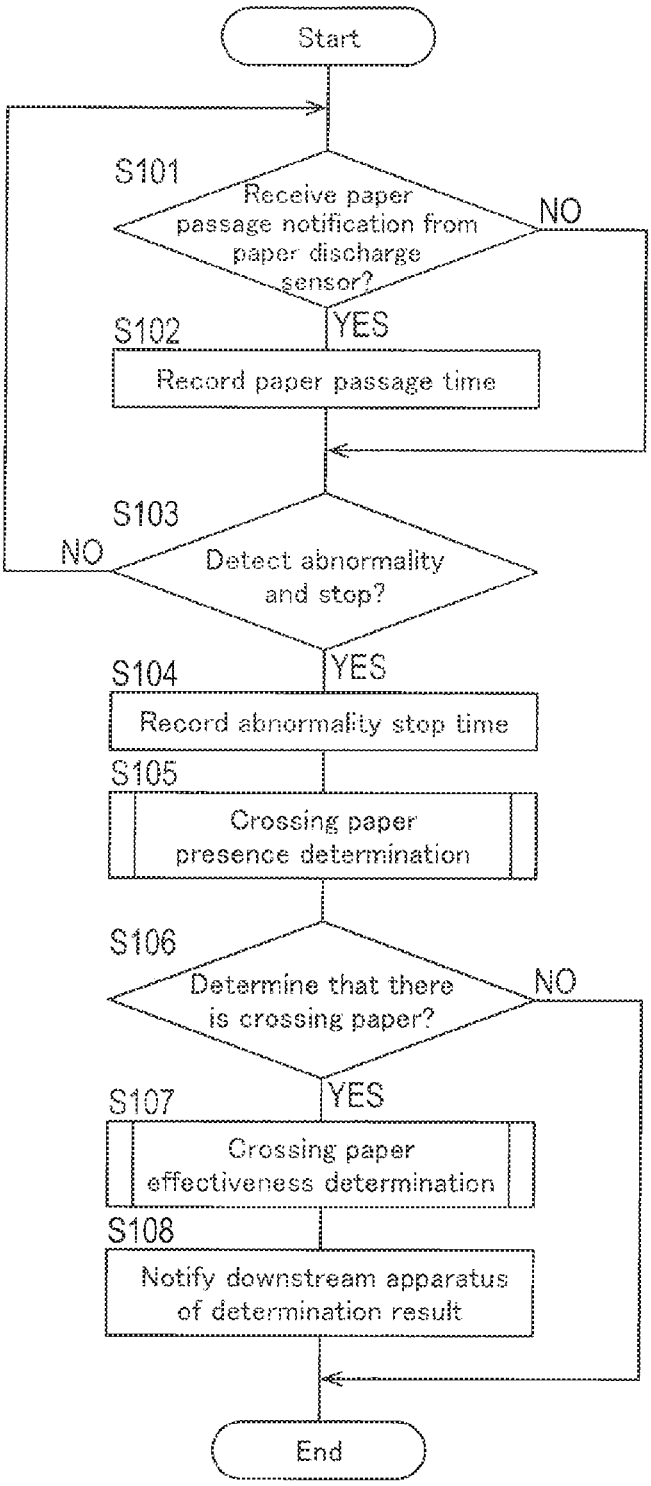
FIG. 6 is a flowchart illustrating the procedure of processes which are performed in a causing apparatus.

FIG. 6 is a flowchart illustrating the procedure of processes which are performed in the causing apparatus.

An algorithm illustrated in the flowchart of FIG. 6 is stored as a program in the memory 12 of the image forming apparatus 10, the memory 22 of the humidifying apparatus 20, and the memory 32 of the reading apparatus 30, and is performed by the processor 11, the processor 21, and the processor 31. In the case where the paper 50 is normally conveyed across the causing apparatus and the downstream apparatus, when the causing apparatus stops due to an abnormality, the program controls the causing apparatus such that subsequent processes are optimized. Hereinafter, a description will be provided, as an example, for the case where the image forming apparatus 10 is the causing apparatus; however, the processes are also similar to the case where the humidifying apparatus 20 or the reading apparatus 30 is the causing apparatus.

As illustrated in FIG. 6, in the state in which the image forming apparatus 10 normally conveys the paper 50, the processor 11 serves as the notification unit 111 to determine whether a paper passage notification has been received from the paper discharge sensor 14*s* (step S101).

When the paper passage notification has not been received (step S101: NO), the processor 11 proceeds to the process of step S103.

When the paper passage notification has been received (step S101: YES), the processor 11 serves as the time management unit 112 to record a time at which the reception of the paper passage notification has started (hereinafter, referred to as a "paper passage time") (step S102). The paper passage time corresponds to a time at which the front end of the paper 50 has passed. The processor 11, for example, may record the paper passage time by storing it in the memory 12.

Subsequently, the processor 11 serves as the abnormality detection unit 113 to detect an abnormality of the image forming apparatus 10 during the conveyance of the paper 50, and serves as the stop unit 114 to determine whether it has stopped the image forming apparatus 10 (step S103).

When the processor 11 has not stopped the image forming apparatus 10 (step S103: NO), the processor 11 returns to the process of step S101. Then, the processor 11 repeats the processes of steps S101 to S103, thereby continuing monitoring whether the paper passage notification has been received and to monitor whether the abnormality of the image forming apparatus 10 has been detected. Whenever the paper passage notification is received from the paper discharge sensor 14*s* (step S101: YES), the processor 11 records the paper passage time (step S102). The processor 11 may record the paper passage time by overwriting the latest paper passage time to a previous paper passage time, or may record the paper passage time by adding the latest paper passage time while keeping record of the previous paper passage time obtained in a certain period.

When the processor 11 has stopped the image forming apparatus 10 (step S103: YES), the processor 11 serves as the time management unit 112 to record a time at which the image forming apparatus 10 has stopped due to the abnormality (hereinafter, referred to as an "abnormality stop time") (step S104). The processor 11, for example, may record the abnormality stop time by storing it in the memory 12.

In step S103, there may be a case where, the processor 11 does not have to stop the image forming apparatus 10 since the image forming apparatus 10 is forcibly stopped due to an abnormality such as no supply of power to the image forming apparatus 10. In such a case, when the processor 11 serves as the abnormality detection unit 113 to detect the abnormality of the image forming apparatus 10, the processor 11 serves as the stop unit 114 to determine whether the image forming apparatus 10 has stopped, and performs subsequent processes.

Subsequently, the processor 11 determine the presence or absence of crossing paper, as a crossing paper presence determination process (step S105). The crossing paper presence determination is performed on the basis of the paper passage time recorded in step S102 and the abnormality stop time recorded in step S104. Details of the process of step S105 will be described later.

Subsequently, the processor 11 confirms whether it is determined that there is the crossing paper in the crossing paper presence determination process of step S105 (step S106).

When it is not determined that there is the crossing paper (step S106: NO), that is, when it is determined that there is no crossing paper, the processor 11 ends the procedure.

When it is determined that there is the crossing paper (step S106: YES), the processor 11 determines whether the crossing paper is effective paper or ineffective paper as a crossing paper effectiveness determination process (step S107). Details of the process of step S107 will be described later.

Subsequently, the processor 11 serves as the notification unit 111 to notify the humidifying apparatus 20, which is a downstream apparatus connected to the image forming apparatus 10, of the determination result by the process of step S107 (step S108). Then, the processor 11 ends the procedure.

As described above, when the crossing paper is the ineffective paper, if the crossing paper is pulled out from the stopped conveying unit 14 and is conveyed, since subsequent normal processes are performed for the ineffective paper, wasteful processing occurs. In this regard, in the present embodiment, the processor 11 notifies the humidifying apparatus 20 of the determination result such that normal processes are prevented from being continued.

Next, details of the crossing paper presence determination process of step S105 of FIG. 6 will be described.

Figure 7:
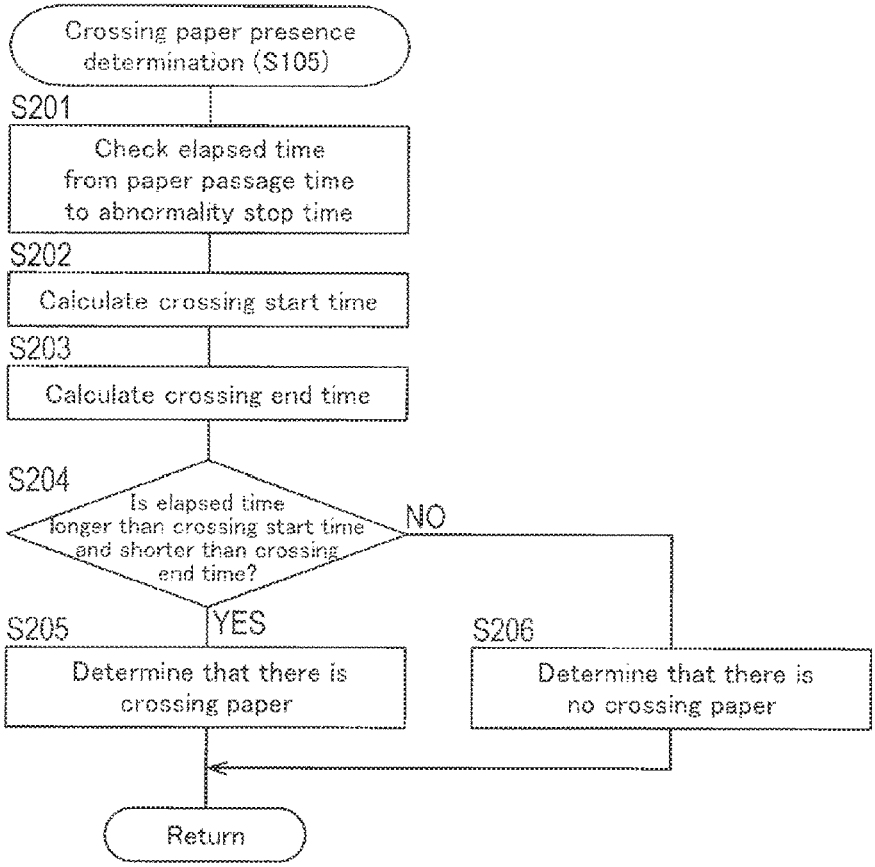
FIG. 7 is a subroutine flowchart illustrating the procedure of a crossing paper presence determination process illustrated in step S105 of FIG. 6.

FIG. 7 is a subroutine flowchart illustrating the procedure of the crossing paper presence determination process illustrated in step S105 of FIG. 6.

As illustrated in FIG. 7, the processor 11 serves as the time management unit 112 to check an elapsed time from the paper passage time to the abnormality stop time on the basis of the latest paper passage time recorded in step S102 and the abnormality stop time recorded in step S104 (step S201).

Subsequently, the processor 11 serves as the determination unit 115 to calculate a time required until the front end of the paper 50 starts to extend across the image forming apparatus 10 and the humidifying apparatus 20 after passing through the paper discharge sensor 14*s* (hereinafter, referred to as an "crossing start time") (step S202). The memory 12 stores in advance information on a conveyance speed v of the paper 50 being conveyed and a distance x from the paper discharge sensor 14*s* to an inlet of a conveyance path of the humidifying apparatus 20. On the basis of these pieces of information, the processor 11 divides the distance by the conveyance speed (x/v), thereby calculating the crossing start time.

Subsequently, the processor 11 serves as the determination unit 115 to calculate a time required until the front end of the paper 50 gets out of the crossing state across the image forming apparatus 10 and the humidifying apparatus 20 after passing through the paper discharge sensor 14*s* (hereinafter, referred to as an "crossing end time") (step S203). The memory 12 stores in advance information on the conveyance speed v of the paper 50 being conveyed, the length p of the paper 50 being conveyed, and a distance y from the paper discharge sensor 14*s* to an outlet of the conveyance path of the image forming apparatus 10. On the basis of these pieces of information, the processor 11 divides a sum value of the distance and the length of the paper 50 by the conveyance speed ((y+p)/v), thereby calculating the crossing end time.

Subsequently, the processor 11 serves as the determination unit 115 to determine whether the elapsed time from the paper passage time to the abnormality stop time is longer than the crossing start time and is shorter than the crossing end time (step S204). While the elapsed time checked in step S201 is an actually measured value and the crossing start time and the crossing end time calculated in steps S202 and S203 are calculated values, all of them employ, as a starting point, the time point at which the front end of the paper 50 has passed through the paper discharge sensor 14*s*.

When the elapsed time is longer than the crossing start time and is shorter than the crossing end time (step S204: YES), the processor 11 serves as the determination unit 115 to determine that there is the crossing paper (step S205). Then, the processor 11 returns to the process of FIG. 6.

When the elapsed time is not longer than the crossing start time or is not shorter than the crossing end time (step S204: NO), that is, when the elapsed time is shorter than the crossing start time or is longer than the crossing end time, the processor 11 serves as the determination unit 115 to determine that there is no crossing paper (step S206). Then, the processor 11 returns to the process of FIG. 6.

As described above, in the crossing paper presence determination process of the present embodiment, the processor 11 determines the presence or absence of the crossing paper on the basis of the elapsed time from the paper passage time to the abnormality stop time. The relation of the elapsed time and the presence or absence of the crossing paper will be further described below.

Figure 8A:
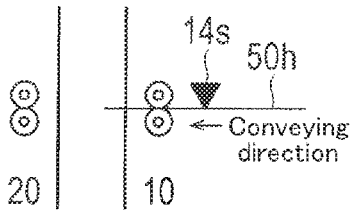
FIG. 8A is a diagram for explaining the relation of an elapsed time and the presence or absence of crossing paper.
Figure 8B:
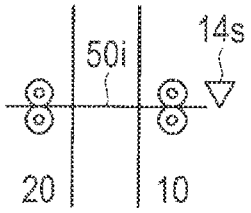
FIG. 8B is a diagram for explaining the relation of an elapsed time and the presence or absence of crossing paper.
Figure 8C:
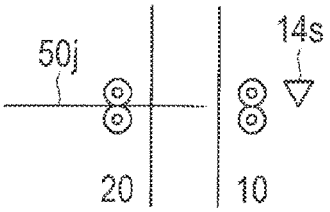
FIG. 8C is a diagram for explaining the relation of an elapsed time and the presence or absence of crossing paper.

FIG. 8A to FIG. 8C is a diagram for explaining the relation of the elapsed time and the presence or absence of the crossing paper.

FIG. 8A to FIG. 8C illustrates the conveyance states of paper when the image forming apparatus 10 has stopped due to an abnormality.

FIG. 8A illustrates a case where the elapsed time is equal to or is shorter than the crossing start time. In this case, paper 50*h* does not reach the humidifying apparatus 20, and the processor 11 determines that there is no crossing paper.

FIG. 8B illustrates a case where the elapsed time is longer than the crossing start time and is shorter than the crossing end time. In this case, paper 50*i* is spanning the image forming apparatus 10 and the humidifying apparatus 20, and the processor 11 determines that there is the crossing paper.

FIG. 8C illustrates a case where the elapsed time is equal to or is longer than the crossing end time. In this case, paper 50*j* is completely separated from the image forming apparatus 10, and the processor 11 determines that there is no crossing paper.

As described above, only when the elapsed time is longer than the crossing start time and is shorter than the crossing end time, the paper 50 is the crossing paper.

Next, details of the crossing paper effectiveness determination process of step S107 of FIG. 6 will be described.

Figure 9:
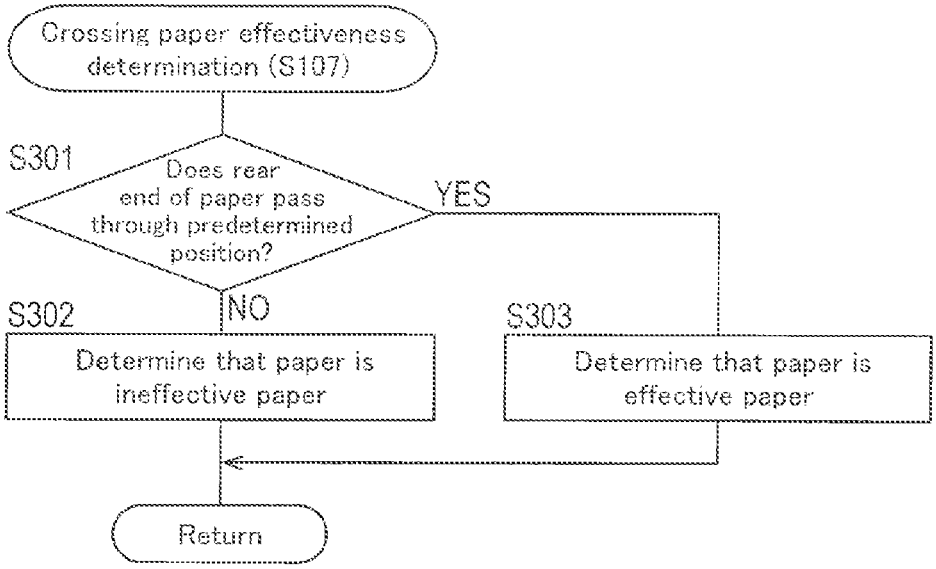
FIG. 9 is a subroutine flowchart illustrating an example of the procedure of a crossing paper effectiveness determination process illustrated in step S107 of FIG. 6.

FIG. 9 is a subroutine flowchart illustrating an example of the procedure of the crossing paper effectiveness determination process illustrated in step S107 of FIG. 6.

As illustrated in FIG. 9, the processor 11 serves as the determination unit 115 to determine whether a rear end of the paper 50, which is crossing paper, passes through a predetermined position when the image forming apparatus 10 has stopped due to an abnormality (step S301).

The predetermined position may be freely set by an operation of a user through the operation panel 15 or the like, or may be automatically set in the position of a component positioned at the most downstream of paper conveyance (except for the conveying unit) of each apparatus. When the image forming apparatus 10 is a causing apparatus, the predetermined position, for example, may be set in the position of the fixing unit 18 by the user, or may be automatically set in the position of the charge control unit 19 positioned at the most downstream of paper conveyance of the image forming apparatus 10. Alternatively, when the image forming apparatus 10 does not perform processes of the charge control unit 19, the predetermined position may be set in the position of the fixing unit 18.

Furthermore, a component that can be set in the predetermined position is provided in the vicinity thereof with a sensor, for transmitting a paper passage notification to processor 11 during the detection of the paper 50 being conveyed. The processor 11 can receive the notification, thereby determining whether the rear end of the paper 50 passes through the predetermined position.

When the rear end of the paper 50 does not pass through the predetermined position (step S301: NO), the processor 11 serves as the determination unit 115 to determine that the paper 50 is ineffective paper (step S302). This is because at least a part of the processes of the image forming apparatus 10 is regarded to be incomplete until the rear end of the paper 50 passes through the predetermined position. Then, the processor 11 returns to the process of FIG. 6.

When the rear end of the paper 50 passes through the predetermined position (step S301: YES), the processor 11 serves as the determination unit 115 to determine that the paper 50 is effective paper (step S303). Then, the processor 11 returns to the process of FIG. 6.

As described above, in the crossing paper effectiveness determination process of the present embodiment, the processor 11 determines whether the crossing paper is effective paper on the basis of whether the rear end of the paper has passed through the predetermined position.

So far, the processes of the causing apparatus of the image forming system 1 have been broadly described. Hereinafter, a description will be provided for processes of the downstream apparatus notified that the crossing paper is the ineffective paper in step S108.

(Processes of Downstream Apparatus)

Details of the processes of the downstream apparatus in the present embodiment will be described.

Figure 10:
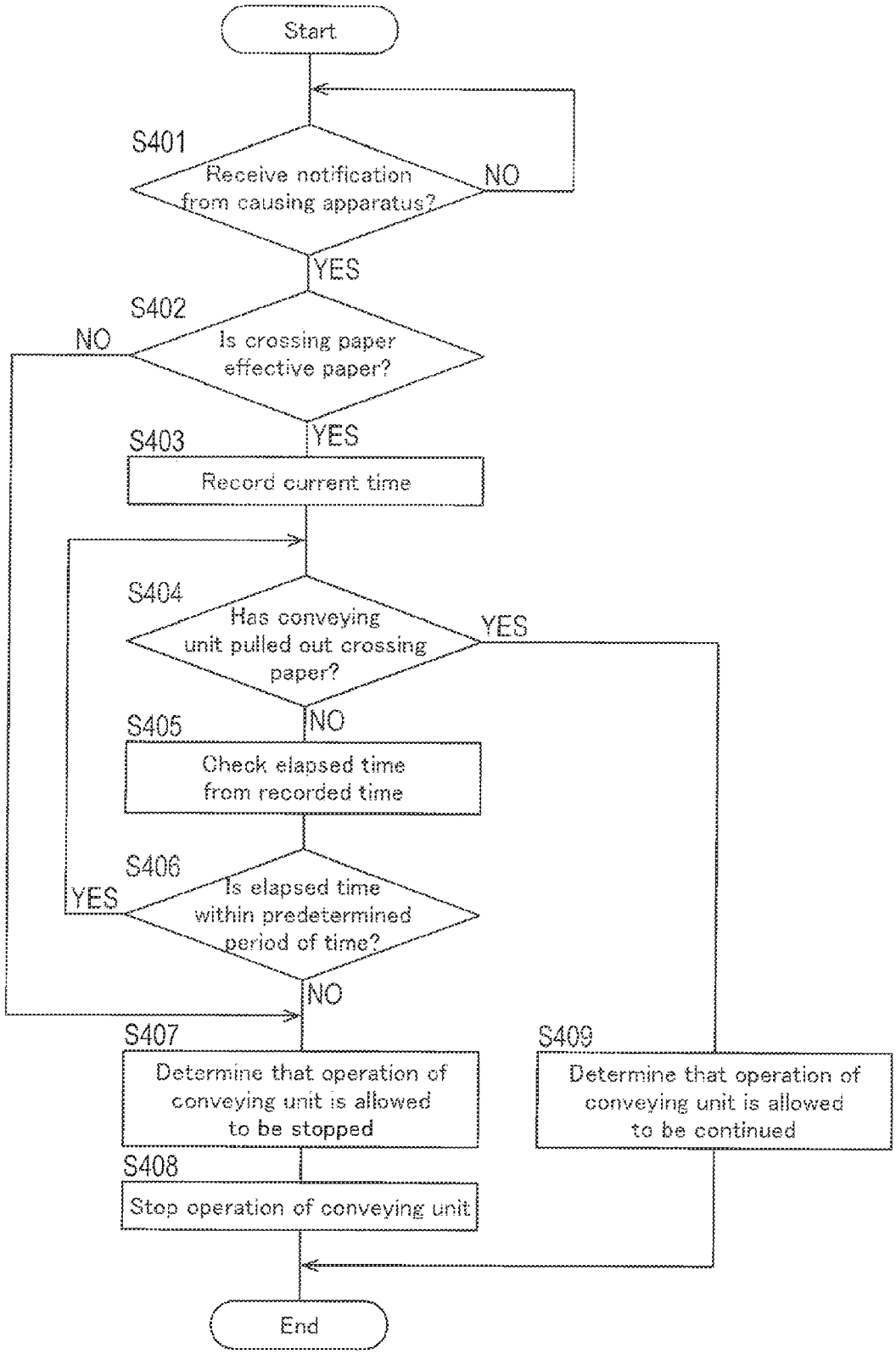
FIG. 10 is a flowchart illustrating an example of the procedure of processes which are performed in a downstream apparatus.

FIG. 10 is a flowchart illustrating an example of the procedure of processes which are performed in the downstream apparatus.

An algorithm illustrated in the flowchart of FIG. 10 is stored as a program in the memory 22 of the humidifying apparatus 20, the memory 32 of the reading apparatus 30, and the memory 42 of the stapling apparatus 40, and is performed by the processor 21, the processor 31, and the processor 41. In the case where the paper 50 is normally conveyed across the causing apparatus and the downstream apparatus, when the causing apparatus stops due to an abnormality, the program controls the downstream apparatus such that subsequent processes are optimized. Hereinafter, a description will be provided, as an example, for the case where the image forming apparatus 10 is the causing apparatus; however, the processes are also similar to the case where the humidifying apparatus 20 or the reading apparatus 30 is the causing apparatus.

As illustrated in FIG. 10, the processor 21 of the humidifying apparatus 20, which is the downstream apparatus connected to the causing apparatus, serves as the notification unit 211 to determine whether the notification of step S108 has been received from the image forming apparatus 10 (step S401).

When the notification has not been received (step S401: NO), the processor 21 continues normal processes while continuing monitoring whether the notification has been received. Consequently, the processor 21 allows each unit of the humidifying apparatus 20 to continue normal processes.

When the notification has been received (step S401: YES), the processor 21 confirms whether the crossing paper is the effective paper on the basis of the determination result included in the notification (step S402).

When the crossing paper is not the effective paper (step S402: NO), that is, when the crossing paper is the ineffective paper, the processor 21 proceeds to the process of step S407. The process of step S407 will be described later.

When the crossing paper is the effective paper (step S402: YES), the processor 21 serves as the time management unit 212 to record a current time (step S403). Then, the processor 21 serves as the determination unit 215 to determine whether the conveying unit 24 continuing operating has pulled out the crossing paper from the stopped image forming apparatus 10 (step S404).

When the conveying unit 24 has not pulled out the crossing paper (step S404: NO), the processor 21 serves as the time management unit 212 to check an elapsed time based on the time recorded in step S403 (step S405). Then, the processor 21 serves as the determination unit 215 to determine whether the elapsed time is within a predetermined period of time (step S406). The predetermined period of time may be freely set by an operation of a user or may be automatically set to an initial value stored in the memory 22 and the like.

When the elapsed time is within the predetermined period of time (step S406: YES), the processor 21 returns to the process of step S404. Then, the processor 21 repeats the processes of steps S404 to S406 until the elapsed time exceeds the predetermined period of time.

When the elapsed time exceeds the predetermined period of time while the conveying unit 24 has not pulled out the crossing paper (step S406: NO), the processor 21 proceeds to the process of step S407.

When step S402 is NO or when step S406 is NO, the processor 21 serves as the determination unit 215 to determine that the operation of the conveying unit 24 is allowed to be stopped (step S407). Then, the processor 21 serves as the stop unit 214 to stop the operation of the conveying unit 24 (step S408). Thereafter, the processor 21 ends the procedure.

On the other hand, when the conveying unit 24 has pulled out the crossing paper (step S404: YES), the processor 21 serves as the determination unit 215 to determine that the operation of the conveying unit 24 is allowed to be continued (step S409). Consequently, the conveying unit 24 continues the conveyance of the pulled-out crossing paper. Then, the processor 21 ends the procedure.

As described above, in the present embodiment, when the crossing paper is the ineffective paper, the processor 21 stops the operation of the conveying unit 24. On the other hand, when the crossing paper is the effective paper, the processor 21 allows the conveying unit 24 to continue operating for the moment.

However, even though the conveying unit 24 continues operating, the conveying unit 24 may not definitely pull out the crossing paper. This is because the abnormality of the image forming apparatus 10, which is the causing apparatus, may be also caused by jam of the crossing paper itself. When the crossing paper damaged by the jam is hooked to the image forming apparatus 10, there is a case where the crossing paper is not pulled out even though the conveying unit 24 continues operating. Furthermore, when the conveying unit 24 intends to forcibly pull out the crossing paper, the jam may become worse more and more. Moreover, when the conveying unit 24 continues operating, a user has difficulty in solving the jam of the crossing paper. In this regard, in the present embodiment, even though the conveying unit 24 pulls out the crossing paper, when the crossing paper is not pulled out within a predetermined period of time, the processor 21 stops the operation of the conveying unit 24 similarly to the case where the crossing paper is the ineffective paper.

As described above, according to the image forming system 1, in a case where the paper 50 is normally conveyed across a causing apparatus and a downstream apparatus by a conveying unit, when the causing apparatus stops due to an abnormality, it is determined whether processes of the causing apparatus has been completed for crossing paper. Consequently, the image forming system 1 can optimize subsequent processes on the basis of the determination result with respect to the crossing paper, so that it is possible to avoid the occurrence of wasteful processing.

Furthermore, in the image forming system 1, the conveying unit in the downstream apparatus continues or stops operating on the basis of the determination result with respect to the crossing paper. Consequently, the image forming system 1 continues normal processes for effective paper and does not continue the normal processes for ineffective paper. As a consequence, the image forming system 1 can improve user's convenience without mixing the ineffective paper in output objects.

Furthermore, in the image forming system 1, even though the conveying unit in the downstream apparatus continues operating, the conveying unit does not definitely pull out the crossing paper. Consequently, the conveying unit in the downstream apparatus stops operating when it does not pull out the crossing paper within a predetermined period of time. As a consequence, in the image forming system 1, it is possible to avoid a situation in which, by forcibly pulling out the crossing paper, the jam becomes worse more and more and a user has difficulty in solving the jam of the crossing paper.

Furthermore, when the causing apparatus stops due to an abnormality, the image forming system 1 determines whether the processes of the causing apparatus has been completed on the basis of whether the rear end of the crossing paper passes through the predetermined position. Consequently, when it is possible to confirm the stop position of the crossing paper, the image forming system 1 can determine the effectiveness of the crossing paper without confirming the states of processes performed for the crossing paper, so that there is no increase in a processing load.

Furthermore, in the image forming system 1, the predetermined position can be set in a position of a component positioned at the most downstream of paper conveyance of each apparatus. In the image forming system 1, the predetermined position, for example, can be set in the charge control unit 19 positioned at the most downstream of the image forming apparatus 10, or the color measuring unit 37 positioned at the most downstream of the reading apparatus 30. Consequently, in the image forming system 1, it is possible to accurately determine the completion of processing.

Furthermore, the predetermined position may be freely set, and in the image forming system 1, the predetermined position can also be set in positions of components not positioned at the most downstream of the paper conveyance of each apparatus. For example, in the image forming system 1, the predetermined position in the image forming apparatus 10 may be set in the position of the fixing unit 18. This is because the image forming system 1 is assumed not to perform the processes of the charge control unit 19. Furthermore, the charge control unit 19, positioned downstream from the fixing unit 18, charges the paper 50 to prevent adhesion of sheets of the paper 50; however, even when the processes of the charge control unit 19 have not been completed, it has no influence on image formation itself on the paper 50. Consequently, when a user does not place great importance on the processes of the charge control unit 19, the predetermined position may be set in the position of the fixing unit 18. As a consequence, in the image forming system 1, it is possible to avoid a meaningless increase in the number of sheets of the ineffective paper, according to user's demands.

Similarly, in the image forming system 1, the predetermined position in the reading apparatus 30 can be set in the position of the bottom surface reading unit 36. This is because the image forming system 1 is assumed not to perform the processes of the color measuring unit 37. Furthermore, the color measuring unit 37, positioned downstream from the bottom surface reading unit 36, is used in order to correct color information acquired by the top surface reading unit 35 and the bottom surface reading unit 36, however, even when the processes of the color measuring unit 37 have not been completed, it has no influence on image formation itself on the paper 50. Consequently, when a user does not place great importance on the processes of the color measuring unit 37, the predetermined position may be set in the position of the color measuring unit 37. As a consequence, in the image forming system 1, it is possible to avoid a meaningless increase in the number of sheets of the ineffective paper, according to user's demands.

In the aforementioned embodiment, an example of the processing procedure of the image forming system 1 has been described. However, the present embodiment is not limited thereto. The following various changes, improvements and the like are possible.

In the present embodiment, the conveying units 14, 24, and 34 of the image forming system 1 are respectively provided with the paper discharge sensors 14*s*, 24*s*, and 34*s* in the vicinity of the conveyance roller pair positioned at the most downstream of paper conveyance of each apparatus. However, the present embodiment is not limited thereto and the position of each paper discharge sensor may also be freely changed. As described above, the elapsed time checked in step S201, the crossing start time calculated in step S202, and the crossing end time calculated in step S203 all employ, as a starting point, the time point at which the front end of the paper 50 has passed through each paper discharge sensor. In the image forming system 1, if the position of each paper discharge sensor serving as a reference in these steps can be fixed, even though each paper discharge sensor is not able to be installed in the vicinity of the conveyance roller pair positioned at the most downstream of the paper conveyance, the present embodiment can be implemented.

Furthermore, in step S202, the image forming system 1 calculates the crossing start time on the basis of the "distance from the paper discharge sensor of the causing apparatus to the inlet of the conveyance path of the downstream apparatus". However, the present embodiment is not limited thereto. In order to further improve the accuracy of processing, the image forming system 1 may change the distance to a "distance from the paper discharge sensor of the causing apparatus to a conveying roller positioned at the most upstream of the paper conveyance of the downstream apparatus", and calculate the crossing start time. The front end of the paper 50 is pulled out only when reaching the conveying roller of the downstream apparatus. Consequently, when the front end of the paper 50 does not reach the conveying roller of the downstream apparatus, the image forming system 1 may determine that there is no crossing paper. The image forming system 1 can omit the crossing paper effectiveness determination process of step S107 for the crossing paper not reaching the conveying roller of the downstream apparatus.

Furthermore, in step S202, the image forming system 1 calculates the crossing start time on the basis of the "distance from the paper discharge sensor of the causing apparatus to the inlet of the conveyance path of the downstream apparatus". On the other hand, in step S203, the image forming system 1 calculates the crossing end time on the basis of the "distance from the paper discharge sensor of the causing apparatus to the outlet of the conveyance path of the causing apparatus". However, since the causing apparatus and the downstream apparatus have been connected to each other, the position of the outlet of the conveyance path of the causing apparatus and the position of the inlet of the conveyance path of the downstream apparatus connected to the causing apparatus may also be very close to each other. In this case, the distance used in step S202 may be changed to the distance used in step S203 to calculate the crossing start time. In this way, the image forming system 1 can calculate the crossing start time on the basis of a condition depending on only the causing apparatus, thereby simplifying the processing.

Moreover, in step S202, in order to further simplify the processing, the image forming system 1 may also calculate the crossing end time as a "time until the rear end of the paper 50 passes through the paper discharge sensor after the front end of the paper 50 passes through the paper discharge sensor". When the rear end of the paper 50 passes through the position of the paper discharge sensor positioned in the vicinity of the most downstream of the paper conveyance of the causing apparatus, the paper 50 is definitely the effective paper. Consequently, when the rear end of the paper 50 passes through the paper discharge sensor of the causing apparatus, the image forming system 1 may also determine that there is no crossing paper in order to omit the crossing paper effectiveness determination process of step S107.

Furthermore, in step S407, the image forming system 1 stops the operation of the conveying unit of the downstream apparatus. However, the image forming system 1 may also be configured to notify a user of the stop of the operation of the conveying unit of the downstream apparatus as well as stopping the operation of the conveying unit of the downstream apparatus. In this way, the user can quickly confirm the occurrence of the ineffective paper.

(Variation 1)

Hereinafter, with reference to the drawings, variations of the present embodiment will be described.

In the aforementioned embodiment, when the causing apparatus has stopped, the conveying unit of the downstream apparatus stops the conveyance of the crossing paper, which is the ineffective paper, in order to optimize subsequent processes for the crossing paper. In the variation 1, even when the crossing paper is the ineffective paper, the conveying unit of the downstream apparatus continues conveying the crossing paper and optimizes processing.

Figure 11:
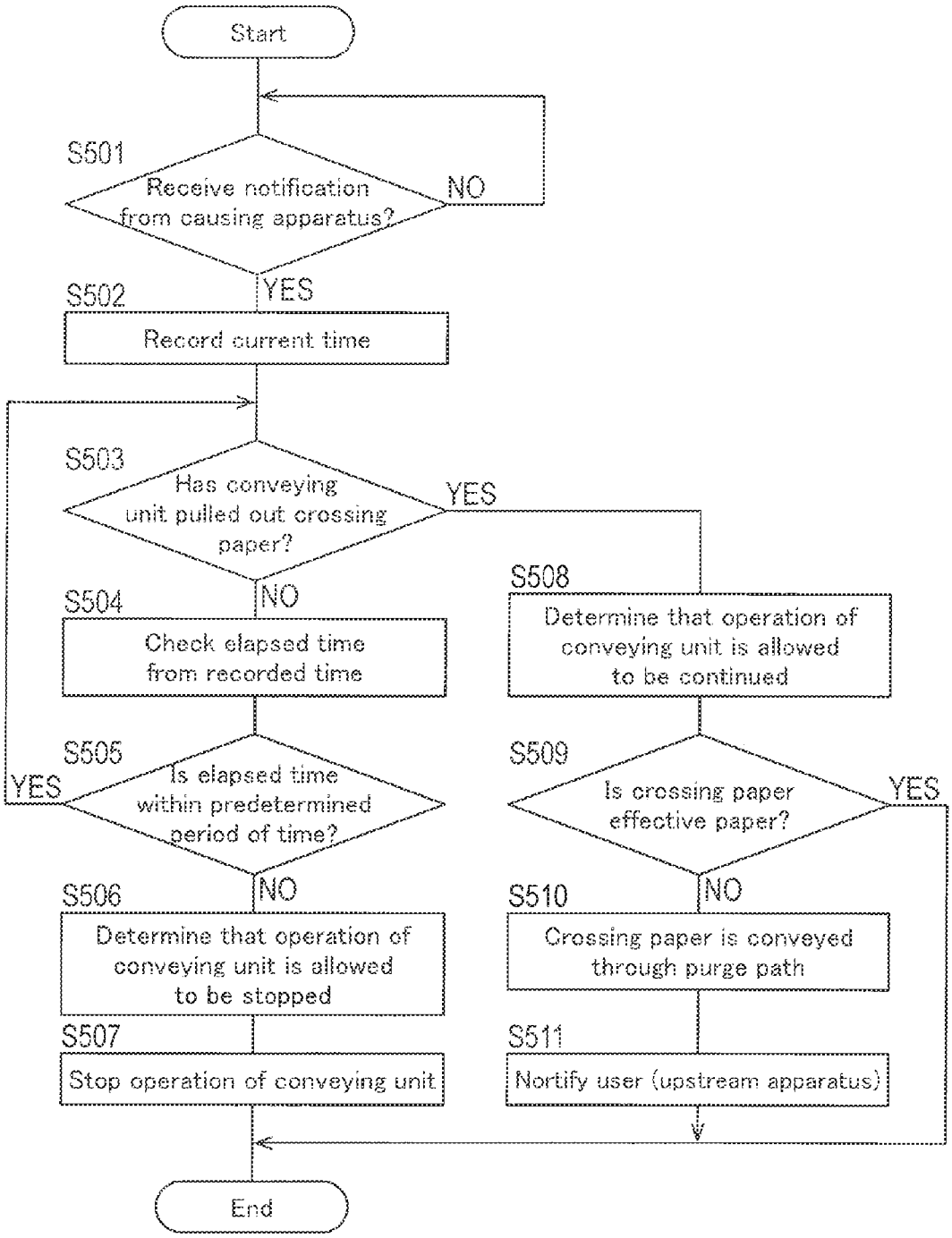
FIG. 11 is a flowchart illustrating another example of the procedure of processes which are performed in the downstream apparatus.

FIG. 11 is a flowchart illustrating another example of the procedure of processes which are performed in the downstream apparatus.

Hereinafter, a description will be provided, as an example, for the case where the image forming apparatus 10 is the causing apparatus; however, the processes are similar to the case where the humidifying apparatus 20 or the reading apparatus 30 is the causing apparatus.

As illustrated in FIG. 11, the processor 21 of the humidifying apparatus 20, which is the downstream apparatus connected to the causing apparatus, serves as the notification unit 211 to determine whether the notification of step S108 has been received from the image forming apparatus 10 (step S501).

When the notification has not been received (step S501: NO), the processor 21 continues normal processes while continuing monitoring whether the notification has been received. Consequently, the processor 21 allows each unit of the humidifying apparatus 20 to continue normal processes.

When the notification has been received (step S501: YES), the processor 21 serves as the time management unit 212 to record a current time (step S502).

Subsequently, the processor 21 serves as the determination unit 215 to determine whether the conveying unit 24 continuing operating has pulled out the crossing paper from the stopped image forming apparatus 10 (step S503).

When the conveying unit 24 has not pulled out the crossing paper (step S503: NO), the processor 21 serves as the time management unit 212 to check an elapsed time based on the time recorded in step S502 (step S504). Then, the processor 21 serves as the determination unit 215 to determine whether the elapsed time is within a predetermined period of time (step S505). The predetermined period of time may be freely set by an operation of a user or may be automatically set to an initial value stored in the memory 22 and the like.

When the elapsed time is within the predetermined period of time (step S505: YES), the processor 21 returns to the process of step S503. Then, the processor 21 repeats the processes of steps S503 to S505 until the elapsed time exceeds the predetermined period of time.

When the elapsed time exceeds the predetermined period of time while the conveying unit 24 has not pulled out the crossing paper (step S505: NO), the processor 21 serves as the determination unit 215 to determine that the operation of the conveying unit 24 is allowed to be stopped (step S506). Then, the processor 21 serves as the stop unit 214 to stop the operation of the conveying unit 24 (step S507). Thereafter, the processor 21 ends the procedure.

On the other hand, when the conveying unit 24 has pulled out the crossing paper (step S503: YES), the processor 21 serves as the determination unit 215 to determine that the operation of the conveying unit 24 is allowed to be continued (step S508). Then, the processor 21 confirms whether the pulled-out crossing paper is the effective paper on the basis of the determination result included in the notification received in step S501 (step S509).

When the pulled-out crossing paper is the effective paper (step S509: YES), the processor 21 ends the procedure. Consequently, the processor 21 allows the conveying unit 24 to convey the pulled-out crossing paper through a normal path directed to the main tray 47 (a normal tray) of the stapling apparatus 40.

When the pulled-out crossing paper is not the effective paper (step S509: NO), that is, when the pulled-out crossing paper is the ineffective paper, the processor 21 allows the conveying unit 24 to convey the pulled-out crossing paper through a purge path directed to the sub-tray 26 (a purge tray) (step S510). Then, in order to notify a user of the conveyance of the crossing paper to the sub-tray 26, the processor 21 serve as the notification unit 211 to notify the image forming apparatus 10 positioned upstream (step S511) and ends the procedure.

In the variation 1, the processor 11 of the image forming apparatus 10 may also serve as a user notification unit. When the processor 11 serves as the notification unit 111 to receive the notification of step S511 from the humidifying apparatus 20, the processor 11 serves as the user notification unit to transmit a notification to a user. The user notification unit may allow the operation panel 15 to display the notification content. Furthermore, the user notification unit may also transmit a notification to a PC, a mobile terminal and the like of the user via the communication unit 13. Alternatively, the processor 21 of the humidifying apparatus 20 or the processor 31 of the reading apparatus 30 may also serve as the user notification unit to directly transmit a notification to the user.

As described above, the variation 1 is different from the procedure of FIG. 10 in that, even when the crossing paper is the ineffective paper, the processor 21 allows the conveying unit 24 to continue the conveyance of paper.

As described above, according to the image forming system 1 of the variation 1, the conveying unit in the downstream apparatus continues operating even when the crossing paper is the ineffective paper, and optimizes subsequent processes on the basis of the determination result of the crossing paper of the causing apparatus. Consequently, the image forming system 1 can convey the effective paper to the normal tray and convey the ineffective paper to the purge tray. In the aforementioned embodiment, the image forming system 1 stops the conveyance of the crossing paper which is the ineffective paper, but when an abnormality is removed to restart printing, a user is required to manually take out the crossing paper. However, in the present variation 1, the image forming system 1 can convey the crossing paper which is the ineffective paper to the purge tray, so that it is possible to reduce time and effort of the user.

Furthermore, when the crossing paper is conveyed to the purge tray, the image forming system 1 transmits a notification to a user. Consequently, the user can quickly confirm the occurrence of the ineffective paper, can confirm the content of an image formed on the ineffective paper, and can quickly instruct re-printing and the like. As a consequence, the image forming system 1 can improve user's convenience.

In addition, in step S510, the image forming system 1 conveys the ineffective paper through the purge path directed to the sub-tray of the downstream apparatus. However, when the humidifying apparatus 20 is the causing apparatus, the reading apparatus 30, which is the downstream apparatus connected to the causing apparatus, is not provided with the sub-tray. In such a case, the image forming system 1 may also convey the ineffective paper toward the sub-tray of the downstream stapling apparatus 40.

(Variation 2)

In the aforementioned embodiment, a component, which can be set in the predetermined position in the crossing paper effectiveness determination process, is provided in the vicinity thereof with a dedicated sensor. In the variation 2, when the component is not provided in the vicinity thereof with the sensor, the crossing paper effectiveness determination process is performed using a separate sensor.

For example, the fixing unit 18 of the image forming apparatus 10 reaches a very high temperature because it is necessary to heat the paper 50. Therefore, it is not realistic that the fixing unit 18 is provided in the vicinity thereof with a sensor. Furthermore, a component, other than the fixing unit 18, also may not be provided in the vicinity thereof with a sensor due to space insufficiency and the like. In the variation 2, even in such a case, the crossing paper effectiveness determination process is possible.

Figure 12:
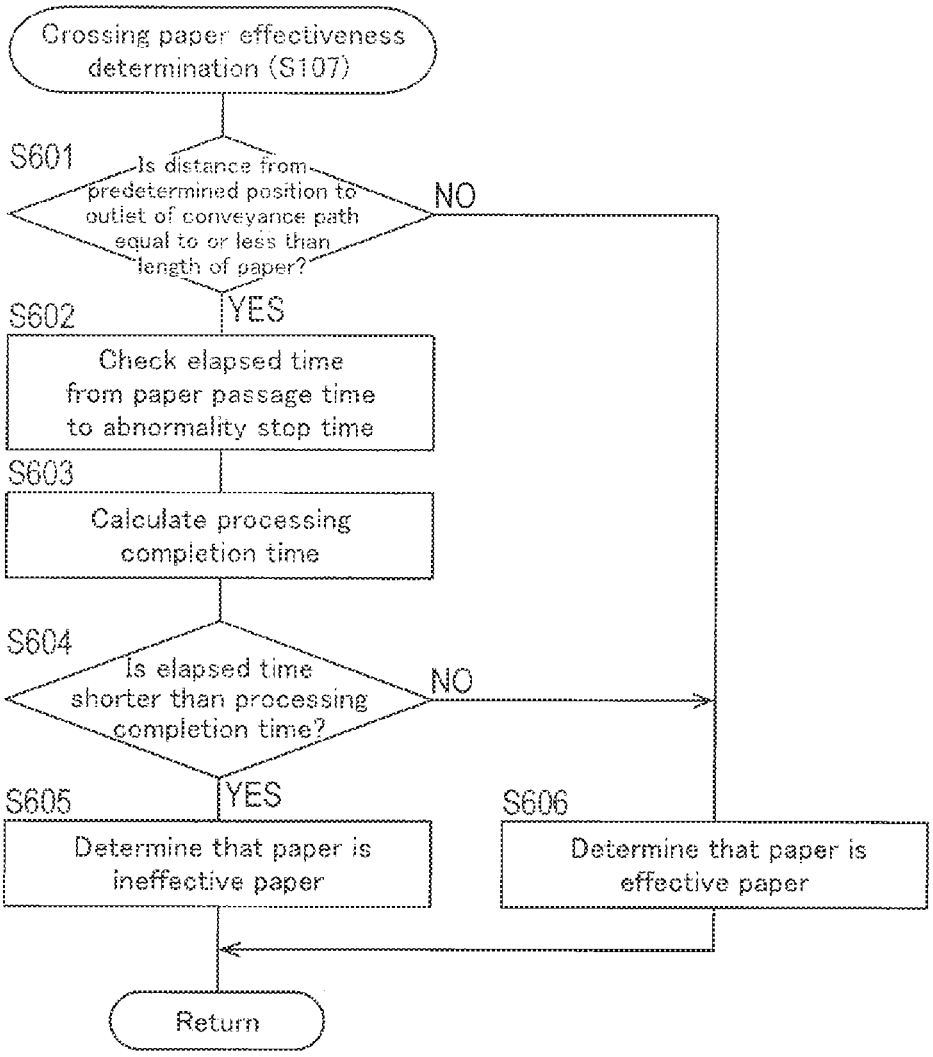
FIG. 12 is a subroutine flowchart illustrating another example of the procedure of the crossing paper effectiveness determination process illustrated in step S107 of FIG. 6.

FIG. 12 is a subroutine flowchart illustrating another example of the procedure of the crossing paper effectiveness determination process illustrated in step S107 of FIG. 6.

Hereinafter, a description will be provided, as an example, for the case where the image forming apparatus 10 is the causing apparatus and the predetermined position is the position of the charge control unit 19; however, the processes are also similar to the case where the humidifying apparatus 20 or the reading apparatus 30 is the causing apparatus and the predetermined position is the position of the fixing unit 18.

As illustrated in FIG. 12, the processor 11 serves as the determination unit 115 to determine whether a distance from the position of the charge control unit 19, which is the predetermined position, to an outlet of the conveyance path (hereinafter, referred to as a "distance α(alpha)") is equal to or less than the length of the paper 50 being conveyed (step S601). The memory 12 stores in advance information on the distance from the position of the charge control unit 19 to the outlet of the conveyance path.

When the distance α is not equal to nor less than the length of the paper 50 (step S601: NO), that is, when the distance α exceeds the length of the paper 50, the processor 11 proceeds to the process of step S606. The fact that the paper 50 is spanning apparatuses represents that the front end of the paper 50 reaches the boundary of the image forming apparatus 10 and the humidifying apparatus 20 and the rear end of the crossing paper 50 shorter than the distance α definitely passes through the predetermined position. Consequently, the crossing paper is definitely an effective paper. Since the magnitude relation of the distance and the length of the paper 50 depends on the size of the paper 50 being conveyed, the processor 11 needs to perform step S601. The process of step S606 will be described later.

When the distance α is equal to or less than the length of the paper 50 (step S601: YEs), the processor 11 proceeds to the process of step S602. In this case, at the time point of step S601, it is not clear whether the paper 50, which is the crossing paper, is an effective paper or an ineffective paper.

Subsequently, the processor 11 serves as the time management unit 112 to check an elapsed time from the paper passage time to the abnormality stop time on the basis of the latest paper passage time recorded in step S102 and the abnormality stop time recorded in step S104 (step S602).

Subsequently, the processor 11 serves as the determination unit 115 to calculate a time required until the rear end of the paper 50 passes through the charge control unit 19 after the front end of the paper 50 passes through the paper discharge sensor 14*s* (hereinafter, referred to as a "processing completion time") (step S603). The memory 12 stores in advance information on a conveyance speed v of the paper 50, the length p of the paper 50 being conveyed, and a distance z from the outlet of the charge control unit 19 to the paper discharge sensor 14*s*. On the basis of these pieces of information, the processor 11 divides a value, which is obtained by subtracting the distance from the length of the paper 50, by the conveyance speed ((p-z)/v), thereby calculating the processing completion time.

Subsequently, the processor 11 serves as the determination unit 115 to determine whether the elapsed time from the paper passage time to the abnormality stop time is shorter than the processing completion time (step S604). While the elapsed time checked in step S602 is an actually measured value and the processing completion time calculated in step S603 is a calculated value, both of them employ, as a starting point, the time point at which the front end of the paper 50 has passed through the paper discharge sensor 14*s*.

When the elapsed time is shorter than the processing completion time (step S604: YES), the processor 11 serves as the determination unit 115 to determine that the paper 50 is the ineffective paper because the rear end of the paper 50 has not passed through the position of the charge control unit 19 (step S605). Then, the processor 11 returns to the process of FIG. 6.

When the elapsed time is not shorter than the processing completion time (step S604: NO), that is, when the elapsed time is equal to or longer than the processing completion time, the processor 11 proceeds to the process of step S606.

When step S601 is NO or when step S604 is NO, the processor 11 serves as the determination unit 115 to determine that the paper 50 is the effective paper because the rear end of the paper 50 has passed through the position of the charge control unit 19 (step S606). Then, the processor 11 returns to the process of FIG. 6.

As described above, according to the image forming system 1 of the variation 2, even when a component, which can be set in the predetermined position, is not provided in the vicinity thereof with a sensor, the crossing paper effectiveness determination process is performed using the paper discharge sensor of each apparatus. Consequently, in the image forming system 1, the paper discharge sensor can be commonly used and the crossing paper effectiveness determination process can be performed without adding a new sensor.

In addition, in the image forming system 1, the crossing paper effectiveness determination process may also be performed using other sensors other than the paper discharge sensor. In the image forming system 1, for example, the crossing paper effectiveness determination process may also be performed using a sensor positioned on an upstream side of the predetermined position. In this case, in the image forming system 1, it is sufficient if the processing completion time is calculated on the basis of a distance from the separate sensor positioned on the upstream side to the predetermined position.

(Variation 3)

In the aforementioned embodiment, the causing apparatus performs the crossing paper presence determination process using its own paper discharge sensor. In the variation 3, the causing apparatus performs the crossing paper presence determination process by also using a component other than its own paper discharge sensor.

FIG. 13A to FIG. 13E is a diagram for explaining a sensor used in the variation 3.

FIG. 13A to FIG. 13E illustrates the conveyance states of paper when the image forming apparatus 10 has stopped due to an abnormality. Hereinafter, a description will be provided, as an example, for the case where the image forming apparatus 10 is the causing apparatus; however, the processes are also similar to the case where the humidifying apparatus 20 or the reading apparatus 30 is the causing apparatus.

As illustrated in FIG. 13, in the variation 3, the conveying unit 24 of the humidifying apparatus 20, which is a downstream apparatus connected to the causing apparatus, is provided with an inlet sensor 24*s*' in the vicinity of a conveying roller pair positioned at the most upstream of paper conveyance. The inlet sensor 24*s*' is configured to transmit a paper passage notification to the processor 11 of the image forming apparatus 10 via the communication unit 23 during the detection of the paper 50 being conveyed. The processor 11 performs the crossing paper presence determination process on the basis of the paper passage notification from the paper discharge sensor 14*s* and the paper passage notification from the inlet sensor 24*s*'.

Figure 13A:
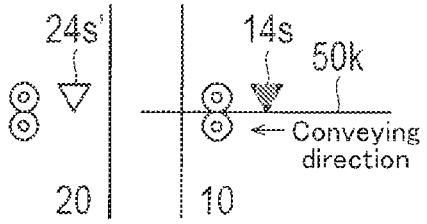
FIG. 13A is a diagram for explaining a sensor used in a variation 3.

In FIG. 13A, paper 50*k* is detected by the paper discharge sensor 14*s*, but is not detected by the inlet sensor 24*s*'. In this case, the processor 11 determines that there is no crossing paper.

Figure 13B:
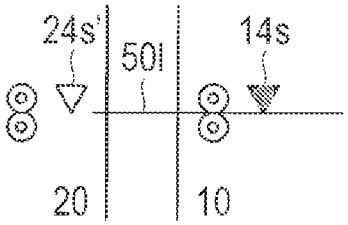
FIG. 13B is a diagram for explaining a sensor used in a variation 3.

In FIG. 13B, paper 501 is detected by the paper discharge sensor 14*s*, is not detected by the inlet sensor 24*s*', and is crossing the image forming apparatus 10 and the humidifying apparatus 20. The front end of the paper 501 does not reach the conveying roller of the downstream apparatus and is not pulled out. Consequently, in this case, the processor 11 determines that there is no crossing paper in order to omit the crossing paper effectiveness determination process.

Figure 13C:
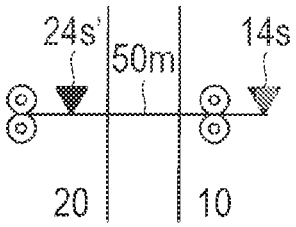
FIG. 13C is a diagram for explaining a sensor used in a variation 3.

In FIG. 13C, since paper 50*m* is detected by both the paper discharge sensor 14*s* and the inlet sensor 24*s*', the processor 11 determines that there is the crossing paper.

Figure 13D:
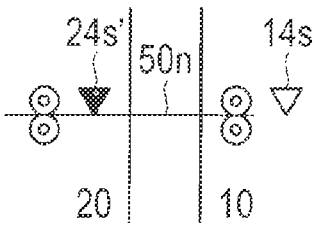
FIG. 13D is a diagram for explaining a sensor used in a variation 3.

In FIG. 13D, paper 50*n* is detected by the inlet sensor 24*s*', is not detected by the paper discharge sensor 14*s*, and is crossing the image forming apparatus 10 and the humidifying apparatus 20. When the rear end of the paper 50*n* passes through the position of the paper discharge sensor 14*s*, since the processes of the causing apparatus for the paper 50*n* has been completed, the paper 50*n* is definitely effective paper. Consequently, in this case, the processor 11 determines that there is no crossing paper in order to omit the crossing paper effectiveness determination process.

Figure 13E:
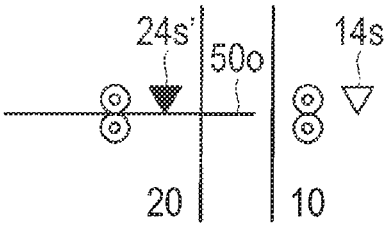
FIG. 13E is a diagram for explaining a sensor used in a variation 3.

In FIG. 13E, paper 50*o* is detected by the inlet sensor 24*s*', but is not detected by the paper discharge sensor 14*s*. In this case, the processor 11 determines that there is no crossing paper.

As described above, according to the image forming system 1 of the variation 3, the crossing paper presence determination process is performed on the basis of the paper passage notification from the paper discharge sensor of the causing apparatus and the paper passage notification from the inlet sensor of the downstream apparatus connected to the causing apparatus. The image forming system 1 can determine the presence or absence of the crossing paper even without performing complicated calculation for the crossing paper presence determination in the aforementioned embodiment. Furthermore, the image forming system 1 can confirm actual passage of paper independently of a calculated value, thereby performing the determination according to use states.

In addition, the image forming system 1 may also perform the crossing paper presence determination process using only the inlet sensor of the downstream apparatus connected to the causing apparatus. As described above, the inlet sensor is positioned in the vicinity of the conveying roller pair positioned at the most upstream of the paper conveyance. Consequently, the paper 50 may be determined to start to span at the paper passage time in the inlet sensor. In this case, it is sufficient if the image forming system 1 calculates a crossing end time on the basis of a distance between the inlet sensor and peripheral components, and the like.

In the aforementioned embodiment, the image forming apparatus 10 and the like in the image forming system 1 have been described as one apparatus. However, the present embodiment is not limited thereto. For example, in relation to the image forming apparatus 10, an information processing apparatus for performing the crossing paper presence determination process and the like and an apparatus for performing image formation may be configured separately from each other. In this case, the information processing apparatus and the apparatus for performing image formation are connected to each other via a bus.

The processing of the image forming system 1 according to the present invention can be performed by a dedicated hardware circuit for performing the aforementioned each procedure or can be performed by making the CPU execute programs storing the aforementioned each procedure. When the present invention is implemented by the latter, the aforementioned programs for operating the image forming apparatus 10, the humidifying apparatus 20, the reading apparatus 30, and the stapling apparatus 40 may also be provided by a computer-readable recording medium such as a USB memory, a floppy (the registered trademark) disk, and a CD-ROM, or may also be provided on-line via a network such as the Internet. In this case, the programs recorded on the computer-readable recording medium are normally transferred to and stored in memory, a hard disk and the like. Furthermore, the programs, for example, may also be provided as single application software, or may also be incorporated in software of the image forming apparatus 10, the humidifying apparatus 20, the reading apparatus 30, and the stapling apparatus 40 as one function of the image forming apparatus 10, the humidifying apparatus 20, the reading apparatus 30, and the stapling apparatus 40.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming system, comprising a first apparatus and a downstream second apparatus connected to the first apparatus, the first apparatus conveys paper directly to the second downstream apparatus, each of the first apparatus and the second apparatus including a hardware processor, a conveying unit, and a communication unit for communicating with the other of the first apparatus and the second apparatus, wherein the hardware processor of the first apparatus determines, when the first apparatus stops due to an abnormality at a stop time in a case where the paper is normally conveyed by the conveying unit of the first apparatus across the first apparatus and the second apparatus, whether a crossing paper, which spans the first apparatus and the second apparatus, is present based on an elapsed time from paper passage at a sensor to the stop time, and whether processes of the first apparatus have been completed for the crossing paper.

2. The image forming system of claim 1, wherein, when the first apparatus stops due to the abnormality, the conveying unit of the first apparatus stops operating, wherein, when the hardware processor of the first apparatus determines that the processes of the first apparatus for the crossing paper has been completed, the conveying unit of the second apparatus continues operating, and wherein, when the hardware processor of the first apparatus determines that the processes of the first apparatus for the crossing paper has not been completed, the conveying unit of the second apparatus stops operating.

3. The image forming system of claim 1, further comprising a normal tray and a purge tray, wherein, when the first apparatus stops due to the abnormality, the conveying unit of the first apparatus stops operating, wherein, when the hardware processor of the first apparatus determines that the processes of the first apparatus for the crossing paper has been completed, the conveying unit of the second apparatus continues operating and conveys the crossing paper through a normal path directed to the normal tray, and wherein, when the hardware processor of the first apparatus determines that the processes of the first apparatus for the crossing paper has not been completed, the conveying unit of the second apparatus continues operating and conveys the crossing paper through a purge path directed to the purge tray.

4. The image forming system of claim 3, further comprising a user notification unit which transmits a notification to a user when the crossing paper is conveyed through the purge path.

5. The image forming system of claim 1, wherein the conveying unit of the second apparatus continues operating and the conveying unit of the first apparatus stops operating when the first apparatus stops due to the abnormality, and the hardware processor of the second apparatus determines whether the crossing paper is pulled out from the first apparatus within a predetermined period of time after the stop time, wherein when the crossing paper is pulled out from the first apparatus within the predetermined period of time, the conveying unit of the second apparatus continues conveying the crossing paper, and when the crossing paper is not pulled out from the first apparatus within the predetermined period of time, the conveying unit of the second apparatus stops operating.

6. The image forming system of claim 1, wherein, when a rear end of the crossing paper passes through a predetermined position in the first apparatus, the hardware processor of the first apparatus determines that the processes of the first apparatus has been completed, and wherein, when the rear end of the crossing paper does not pass through the predetermined position in the first apparatus, the hardware processor of the first apparatus determines that the processes of the first apparatus has not been completed.

7. The image forming system of claim 6, wherein the first apparatus comprises a fixing unit which fixes an image on the paper, and the predetermined position is a position of the fixing unit.

8. The image forming system of claim 6, wherein the first apparatus comprises a charge control unit which charges the paper, and the predetermined position is a position of the charge control unit.

9. The image forming system of claim 6, wherein the first apparatus comprises a reading unit which reads an image on the paper, and the predetermined position is a position of the reading unit.

10. The image forming system of claim 6, wherein the first apparatus comprises a color measuring unit which measures a color of an image on the paper, and the predetermined position is a position of the color measuring unit.

11. A method for controlling an image forming system including a first apparatus and a second downstream apparatus connected to the first apparatus, wherein the first apparatus conveys paper directly to the second downstream apparatus, each of the first apparatus and the second apparatus including a hardware processor, a conveying unit, and a communication unit for communicating with the other of the first apparatus and the second apparatus, the method comprising:

(a) determining presence or absence of crossing paper, which is the paper spanning the first apparatus and the second apparatus when the first apparatus stops at a stop time due to an abnormality, based on an elapsed time from paper passage at a sensor to the stop time; and (b) determining, by the hardware processor of the first apparatus, whether processes of the first apparatus has been completed for the crossing paper when it is determined that the crossing paper exists in the step (a).

12. The method of claim 11, further comprising:

(c) continuing an operation of the conveying unit of the second apparatus in a state in which an operation of the conveying unit of the first apparatus is stopped when it is determined that the processes of the first apparatus for the crossing paper has been completed in the step (b), and stopping the operation of the conveying unit of the second apparatus when it is determined that the processes of the first apparatus for the crossing paper has not been completed in the step (b).

13. The method of claim 11, further comprising:

(d) continuing an operation of the conveying unit of the second apparatus and conveying the crossing paper through a normal path directed to a normal tray in a state in which an operation of the conveying unit of the first apparatus is stopped when it is determined that the processes of the first apparatus for the crossing paper has been completed in the step (b), and continuing the operation of the conveying unit of the second apparatus and conveying the crossing paper through a purge path directed to a purge tray when it is determined that the processes of the first apparatus for the crossing paper has not been completed in the step (b).

14. The method of claim 13, further comprising:

(e) transmitting a notification to a user when the crossing paper is conveyed through the purge path.

15. The method of claim 12, further comprising:

(f) determining, by the hardware processor of the second apparatus, whether the crossing paper is pulled out from the first apparatus within a predetermined period of time after the stop time when continuing the operation of the conveying unit of the second apparatus while stopping the operation of the conveying unit of the first apparatus; and (g) continuing conveying the crossing paper by the conveying unit of the second apparatus when it is determined that the crossing paper is pulled out from the first apparatus within the predetermined period of time in the step (f), and stopping operating of the conveying unit of the second apparatus when it is determined that the crossing paper is not pulled out from the first apparatus within the predetermined period of time in the step (f).

16. The method of claim 11, wherein, in the step (b), when a rear end of the crossing paper passes through a predetermined position in the first apparatus, it is determined that the processes of the first apparatus has been completed; and when the rear end of the crossing paper does not pass through the predetermined position in the first apparatus, it is determined that the processes of the first apparatus has not been completed.

17. A paper conveyance processing apparatus which performs predetermined processes for paper to be conveyed and is connectable to another paper conveyance processing apparatus, the paper conveyance processing apparatus comprising:

a first conveying unit which conveys the paper;

a first processing unit which performs the predetermined processes for the paper;

a first communication unit for communicating with the other paper conveyance processing apparatus; and a first hardware processor that determines, when the first apparatus stops due to an abnormality at a stop time in a case where the paper is normally conveyed by the first conveying unit across the paper conveyance processing apparatus and the other paper conveyance processing apparatus, whether a crossing paper which is conveyed across the paper conveyance processing apparatus and the other paper conveyance processing apparatus, is present based on an elapsed time from paper passage at a sensor to the stop time, and whether processes of the first apparatus have been completed for the crossing paper.

18. The paper conveyance processing apparatus of claim 17, wherein the predetermined processes includes at least one of an image forming process or a post-process for the paper.

19. The paper conveyance processing apparatus of claim 17, wherein, when the paper conveyance processing apparatus stops due to the abnormality, the first conveying unit stops operating, wherein, when the first hardware processor determines that the predetermined processes for the crossing paper has been completed, the first hardware processor transmits a notification indicating completion of the predetermined processes to the other paper conveyance processing apparatus, and wherein, when the first hardware processor determines that the predetermined processes for the crossing paper has not been completed, the first hardware processor transmits a notification indicating non-completion of the predetermined processes to the other paper conveyance processing apparatus.

20. The paper conveyance processing apparatus of claim 17, wherein, in a case where the other paper conveyance processing apparatus stops due to an abnormality and a second conveying unit of the other paper conveyance processing apparatus stops operating, when a notification indicating completion of the predetermined processes of the other paper conveyance processing apparatus for the crossing paper is received from the other paper conveyance processing apparatus, the first conveying unit continues operating, and when a notification indicating non-completion of the predetermined processes of the other paper conveyance processing apparatus for the crossing paper is received from the other paper conveyance processing apparatus, the first conveying unit stops operating.

21. The paper conveyance processing apparatus of claim 17, further comprising a normal tray and a purge tray, wherein, in a case where the other paper conveyance processing apparatus stops due to an abnormality and a second conveying unit of the other paper conveyance processing apparatus stops operating, when a notification indicating completion of the predetermined processes of the other paper conveyance processing apparatus for the crossing paper is received from the other paper conveyance processing apparatus, the first conveying unit continues operating and conveys the crossing paper through a normal path directed to the normal tray, and when a notification indicating non-completion of the predetermined processes of the other paper conveyance processing apparatus for the crossing paper is received from the other paper conveyance processing apparatus, the first conveying unit continues operating and conveys the crossing paper through a purge path directed to the purge tray.

22. The paper conveyance processing apparatus of claim 21, further comprising a user notification unit which transmits a notification to a user when the crossing paper is conveyed through the purge path.

23. The paper conveyance processing apparatus of claim 20, wherein, in a case where the first conveying unit continues operating while the second conveying unit stops operating when the other paper conveyance processing apparatus stops operating due to the abnormality, when the crossing paper is pulled out from the other paper conveyance processing apparatus within a predetermined period of time, the first conveying unit continues conveying the crossing paper, and when the crossing paper is not pulled out from the other paper conveyance processing apparatus within the predetermined period of time, the first conveying unit stops operating.

24. The paper conveyance processing apparatus of claim 17, wherein, when a rear end of the crossing paper passes through a predetermined position in the paper conveyance processing apparatus, the hardware processor determines that the predetermined processes has been completed, and wherein, when the rear end of the crossing paper does not pass through the predetermined position in the paper conveyance processing apparatus, the hardware processor determines that the predetermined processes has not been completed.

25. The paper conveyance processing apparatus of claim 24, comprising a fixing unit which fixes an image on the paper, and the predetermined position is a position of the fixing unit.

26. The paper conveyance processing apparatus of claim 24, comprising a charge control unit which charges the paper, and the predetermined position is a position of the charge control unit.

27. The paper conveyance processing apparatus of claim 24, comprising a reading unit which reads an image on the paper, and the predetermined position is a position of the reading unit.

28. The paper conveyance processing apparatus of claim 24, comprising a color measuring unit which measures a color of an image on the paper, and the predetermined position is a position of the color measuring unit.

* * * * *